US011112736B2

(12) United States Patent
Jinkoma et al.

(10) Patent No.: US 11,112,736 B2
(45) Date of Patent: Sep. 7, 2021

(54) HEATER AND FIXING DEVICE

(71) Applicant: CANON KABUSHIKI KAISHA, Tokyo (JP)

(72) Inventors: Yusuke Jinkoma, Susono (JP); Tomonori Sato, Hamamatsu (JP); Atsushi Iwasaki, Susono (JP); Takashi Nomura, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/721,425

(22) Filed: Dec. 19, 2019

(65) Prior Publication Data

US 2020/0125015 A1 Apr. 23, 2020

Related U.S. Application Data

(63) Continuation of application No. 16/175,512, filed on Oct. 30, 2018, now Pat. No. 10,545,437.

(30) Foreign Application Priority Data

Nov. 6, 2017 (JP) ..... JP2017-213858
Mar. 29, 2018 (JP) ..... JP2018-066098

(51) Int. Cl.
*G03G 15/20* (2006.01)

(52) U.S. Cl.
CPC ..... *G03G 15/2039* (2013.01); *G03G 15/2053* (2013.01)

(58) Field of Classification Search
CPC ..... G03G 15/2039; G03G 15/2053
See application file for complete search history.

(56) References Cited

U.S. PATENT DOCUMENTS 5,376,773 A * 12/1994 Masuda ..... G03G 15/2003 219/216
6,870,140 B2 * 3/2005 Cook ..... G03G 15/2039 219/216
9,596,718 B2 * 3/2017 Nakayama ..... H05B 3/0014
9,727,014 B1 8/2017 Tress et al.

FOREIGN PATENT DOCUMENTS

| | | | |
|---|---|---|---|
| CN | 104730887 | A | 6/2015 |
| JP | H0926717 | A | 1/1997 |
| JP | 2002-365961 | A | 12/2002 |
| JP | 2006-019159 | A | 1/2006 |
| KR | 2014-0032509 | A | 3/2014 |
| KR | 2015-0136021 | A | 12/2015 |

* cited by examiner

*Primary Examiner* — Gregory H Curran
(74) *Attorney, Agent, or Firm* — Canon U.S.A., Inc. IP Division

(57) ABSTRACT

In a heater according to the present invention, one of conductive lines is arranged to extend from a temperature detection element toward one end portion of a substrate in a lengthwise direction of the substrate, whereas the other the conductive line is arranged to extend from the temperature detection element toward the other end portion of the substrate in the lengthwise direction of the substrate, and at least one of the two conductive lines has an area that is inclined in both of the lengthwise direction and the widthwise direction of the substrate.

18 Claims, 22 Drawing Sheets

BACK FACE

SLIDING FACE

SLIDING FACE

SLIDING FACE

SLIDING FACE

SLIDING FACE

BACK FACE

SLIDING FACE

SLIDING FACE

WITHOUT CONVEX PORTION

WITH CONVEX PORTION: D = 0.75 mm

WITH CONVEX PORTION: D = 0.50 mm

SLIDING FACE

BACK FACE

BACK FACE

SLIDING FACE

PROXIMAL ENLARGED VIEW OF THERMISTOR 332

L1 CROSS-SECTION VIEW

F1 CROSS-SECTION VIEW

PROXIMAL ENLARGED VIEW OF THERMISTOR 335

L2 CROSS-SECTION VIEW

F2 CROSS-SECTION VIEW

VARIATION EXAMPLE 1

VARIATION EXAMPLE 2

BACK FACE

SLIDING FACE

PROXIMAL ENLARGED VIEW OF THERMISTOR 332

L3 CROSS-SECTION VIEW

F3 CROSS-SECTION VIEW

VARIATION EXAMPLE 3

VARIATION EXAMPLE 4

HEATER AND FIXING DEVICE

The present application is a continuation of U.S. patent application Ser. No. 16/175,512, filed Oct. 20, 2018, entitled "HEATER AND FIXING DEVICE", the content of which is expressly incorporated by reference herein in its entirety. Further, the present application claims priority from Japanese Patent Applications No. 2017-213858, filed Nov. 6, 2017, and No. 2018-066098, filed Mar. 29, 2018, which are hereby incorporated by reference herein in their entirety.

BACKGROUND OF THE INVENTION

Field of the Invention

The present invention relates to a fixing device mounted on an image forming apparatus such as an electrophotographic recording type copying machine or a printer, and to a heater mounted on the fixing device.

Description of the Related Art

Fixing devices using a film are known including fixing devices to be mounted on electrophotographic recording type image forming apparatus. This fixing device includes a tubular film and a heater that is in contact with an inner face of the film. Since the fixing device using a film has low heat capacity, it is advantageous that the device can be operated with a short warm-up time and low power consumption.

The heater includes a substrate made of a material such as ceramics and a heat generating resistor (heat generation element) arranged on the substrate. Temperature of the heater is detected by a temperature detection element such as a thermistor, and a control unit controls the power supplied to the heat generating resistor according to an output of the temperature detection element.

The temperature detection element is configured to be mounted independently from the heater, which is pushed against the heater via an insulation sheet. Further, there is provided a heater-integrated configuration in which a temperature detection element and a conductive line electrically connected to the temperature detection element are arranged on a substrate of the heater through a coating method such as screen printing. In the above heater-integrated configuration, the temperature detection element, the conductive line, and the heat generation element are protected by a glass film for the sake of insulation. This heater-integrated configuration is advantageous in that variation in responsiveness is small and the temperature detection accuracy is high because the temperature detection element is printed on the substrate.

Further, in order to precisely detect a temperature at a fixing nip portion, a configuration is discussed in which a temperature detection element is arranged on a sliding face of a heater that is in contact with a film (Japanese Patent Application Laid-Open no. 10-240357). Further, in order to reduce the heater in size, the heat generating resistor may be arranged on a face opposite to the face of the substrate on which the temperature detection element is arranged.

However, in the above-described configuration of the heater, at a portion where the temperature detection element or the conductive line is arranged, the thickness from a surface of the substrate becomes thicker than that of the other portions, so that irregularity may arise on the surface of the heater. According to the examination conducted by the inventors, a fixing failure or a gloss streak sometimes occurred when a conductive line was formed on a substrate of the heater in parallel with the conveyance direction of a recording material. This is because heat and pressure applied to a toner image become non-uniform because of a step portion generated on the surface of the heater by the conductive line.

The present invention is directed to a heater and a fixing device capable of suppressing occurrence of an image defect such as a fixing failure or a gloss streak.

SUMMARY OF THE INVENTION

According to an aspect of the present invention, a heater used for a fixing device includes a substrate having a lengthwise direction and a widthwise direction, a heat generation element arranged on the substrate, a temperature detection element arranged on a face opposite to a face of the substrate on which the heat generation element is arranged, two conductive lines electrically connected to the temperature detection element, the two conductive lines being arranged on the face opposite to the face of the substrate on which the heat generation element is arranged, and a protection layer that covers the temperature detection element and the two conductive lines, wherein one of the conductive lines is arranged to extend from the temperature detection element to one end portion of the substrate in the lengthwise direction of the substrate, and the other conductive line is arranged to extend from the temperature detection element to the other end portion of the substrate in the lengthwise direction of the substrate, and wherein at least one of the two conductive lines has a region that is inclined in both of the lengthwise direction and the widthwise direction of the substrate in an area covered by the protection layer.

Further features of the present invention will become apparent from the following description of exemplary embodiments with reference to the attached drawings. Each of the embodiments of the present invention described below can be implemented solely or as a combination of a plurality of the embodiments. Also, features from different embodiments can be combined where necessary or where the combination of elements or features from individual embodiments in a single embodiment is beneficial.

DESCRIPTION OF THE EMBODIMENTS

Figure 1:
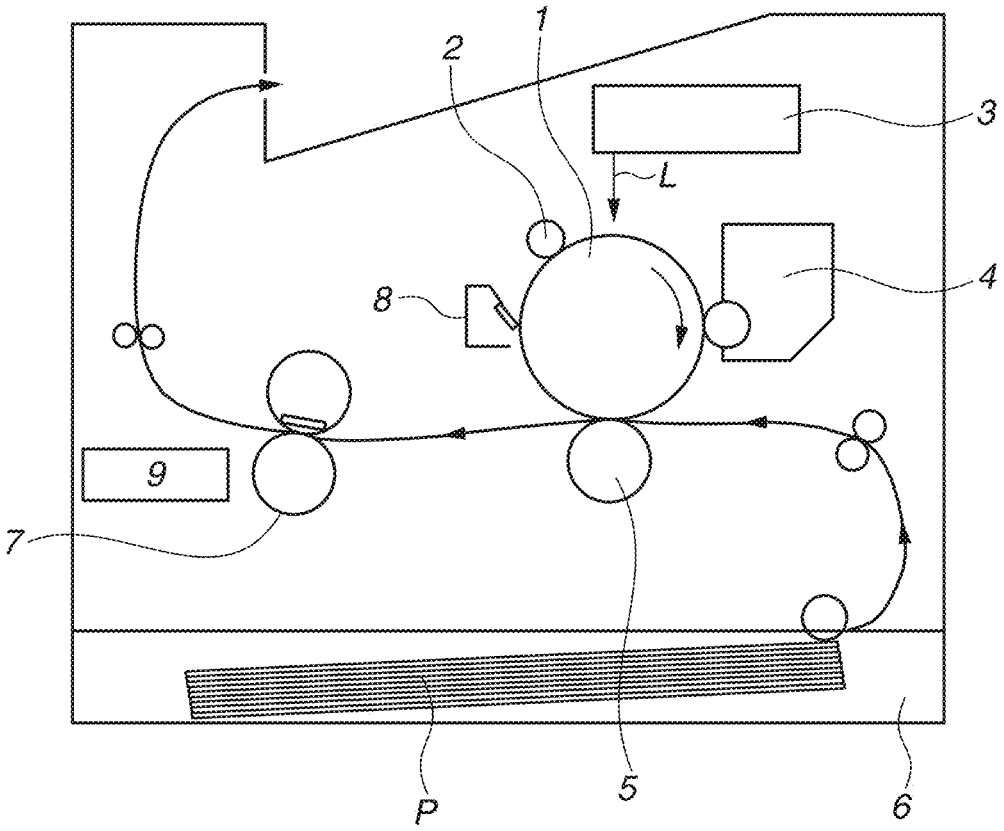
FIG. 1 is a cross section diagram of an image forming apparatus.

FIG. 1 is a cross section diagram of an electrophotographic recording type image forming apparatus. A photosensitive drum 1 is driven and rotated in a direction indicated by an arrow, and a surface thereof is uniformly charged by a charging roller 2. Then, a laser scanner 3 scans the charged surface of the photosensitive drum 1 with a laser beam L according to image information. Through this processing, an electrostatic latent image is formed on the surface of the photosensitive drum 1. The electrostatic latent image is developed with toner supplied from a development unit 4. A toner image formed on the photosensitive drum 1 is transferred to a recording material P fed from a sheet feeding cassette 6 at a transfer nip portion as a press-contact portion formed by a transfer roller 5 and the photosensitive drum 1. The recording material P on which the toner image has been transferred is conveyed to a fixing device 7, so that the toner image is heated and fixed onto the recording material P by the fixing device 7. Thereafter, the recording material P is discharged onto a discharge tray. The toner remaining on the photosensitive drum 1 after the transfer processing is collected by a cleaning unit 8.

<Configuration of Fixing Device 7>

Figure 2:
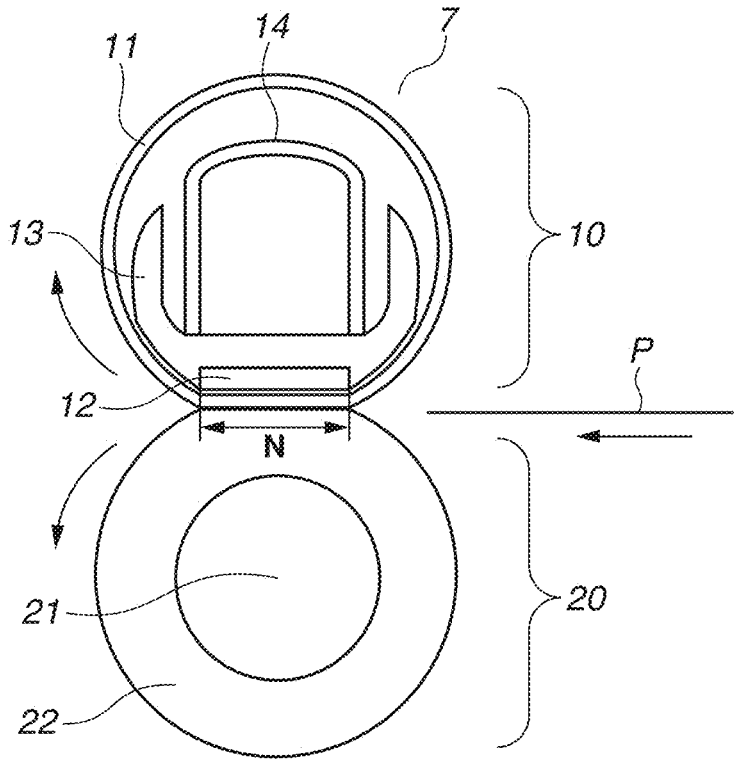
FIG. 2 is a cross section diagram of a fixing device.

Next, the fixing device 7 will be described with reference to FIG. 2. FIG. 2 is a cross section diagram of the fixing device 7. The fixing device 7 includes a film unit 10 and a pressure roller 20, and a fixing nip portion N for nipping and conveying the recording material P is formed at a space between the film unit 10 and the pressure roller 20. The film unit 10 includes a tubular film 11 and a heater 12 that is in contact with an inner face of the film 11. The fixing device 7 further includes a heater holder 13 for holding the heater 12 and a metallic stay 14 urged by a pressure spring (not illustrated) to press the heater holder 13 against the pressure roller 20.

The film 11 includes a base layer and a release layer formed outside of the base layer. The base layer is formed of heat resistant resin such as polyimide, polyamide-imide, or polyether-ether-ketone (PEEK), or metal such as stainless steel (SUS). The release layer is a mixed layer or a single layer of heat resistant resin having favorable releasing performance, such as fluorine resin, e.g., polytetrafluoroethylene (PTFE), tetrafluoroethylene-perfluoroalkyl vinyl ether copolymer (PFA), or tetrafluoroethylene-hexafluoropropylene copolymer (FEP) and silicone resin. Further, an intermediate layer formed of heat resistant rubber such as silicone rubber may be arranged between the base layer and the release layer. The film 11 of the present exemplary embodiment includes a SUS base layer having a thickness of 30 μm, a silicone rubber layer (elastic layer) having a thickness of 200 μm, and a release layer consisting of PFA having a thickness of 20 μm. An outer diameter and a length in the lengthwise direction of the film 11 (i.e., a length in the width direction of the recording material P) are 24 mm and 240 mm, respectively.

The heater holder 13 holds the heater 12, and functions as a guide for guiding rotation of the film 11. The heater holder 13 is formed of heat resistant resin such as liquid crystal polymer.

The metallic stay 14 is a member for reinforcing the heater holder 13. A metallic material such as SUS having high rigidity is used for the metallic stay 14 in order to be sustainable against the load applied thereto when the heater holder 13 is pressed against the pressure roller 20.

The pressure roller 20 includes a core metal 21 and an elastic layer 22 formed on the outer side of the core metal 21. A release layer formed of PFA or PTFE may be arranged on the outer side of the elastic layer 22. The core metal 21 receives driving power from a motor (not illustrated) to rotate the pressure roller 20 in a direction indicated by an arrow. When the pressure roller 20 is rotated, the film 11 is rotated accordingly. The pressure roller 20 according to the present exemplary embodiment includes the elastic layer 22 formed of silicone rubber having a thickness of 3.5 mm and a release layer formed of PFA having a thickness of 70 μm. An outer diameter and a length in the lengthwise direction of the pressure roller 20 are 25 mm and 230 mm, respectively.

The fixing device 7 fixes an image formed on a recording material P onto the recording material P with heat applied from the heater 12 via the rotating film 11.

<Configuration of Heater 12>

Next, a configuration of the heater 12 of a first exemplary embodiment will be described with reference to FIGS. 3A and 3B. The heater 12 includes a substrate 30 and a heat generation element 31 arranged on the substrate 30. The heater 12 further includes a temperature detection element 33 arranged on a face opposite to the face of the substrate 30 on which the heat generation element 31 is arranged, and a conductive line 34 electrically connected to the temperature detection element 33, which is arranged on the face opposite to the face of the substrate 30 on which the heat generation element 31 is arranged.

Figure 3A:
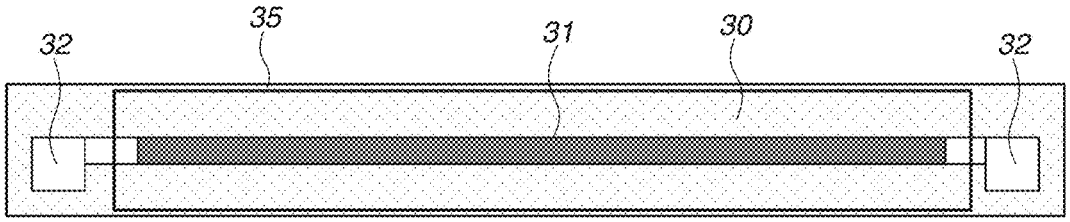
FIGS. 3A and 3B are diagrams illustrating a configuration of a heater according to a first exemplary embodiment.

FIG. 3A is a diagram illustrating a back face of the heater 12, i.e., a face on the opposite side of the sliding face of the heater 12 sliding with the film 11. The heat generating resistor (heat generation element) 31 and an electrode 32 are formed on the alumina substrate 30 through screen printing, and the heat generating resistor 31 is covered with a back face protection layer 35 made of a glass material. A connector (not illustrated) is connected to the electrode 32, and the heat generating resistor 31 receives power supplied from a power source to generate heat. In addition, a ceramic material such as aluminum nitride or a metallic material with a surface thereof covered with an insulation layer may be used as a material of the substrate 30.

Figure 3B:
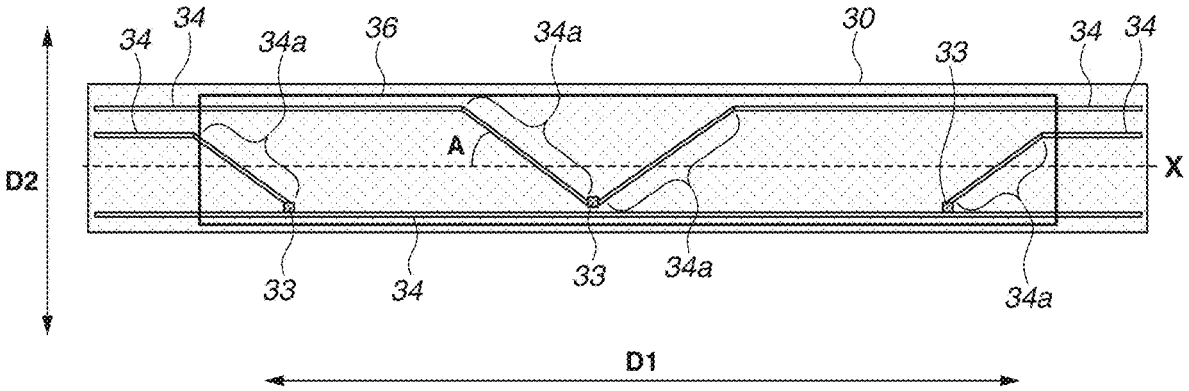

FIG. 3B is a diagram illustrating the sliding face side of the heater 12. A thermistor 33 as a temperature detection element and a conductive line 34 are formed on the sliding face of the heater 12 through screen printing. Since the conductive line 34 is connected to a control circuit 9 within the image forming apparatus via a connector (not illustrated), a temperature detected by the thermistor 33 can be transmitted to the control circuit 9. The present exemplary embodiment is characterized in that the conductive line 34 includes an area 34*a* inclined with respect to both of a lengthwise direction D1 and a widthwise direction D2 of the substrate 30. Although details will be described below, occurrence of an image defect can be suppressed by forming the conductive line 34 in an inclined direction. In addition, a line X represents a center in the widthwise direction D2 of the heater 12.

The thermistor 33 and the conductive line 34 are also covered with a sliding side protection layer 36 made of a glass material arranged on the sliding face side. Since the protection layer 36 arranged on the sliding face side also plays a role of protecting the thermistor 33 and the conductive line 34 from abrasion caused by friction with respect to the film 11, a glass material having the abrasion resistance higher than that of the protection layer on the back face side is used. In addition, silver/palladium (Ag/Pd) is used as a material of the heat generating resistor 31, and silver (Ag) is used as a material of the electrode 32 and the conductive line 34. Further, although the heater 12 according to the present exemplary embodiment includes a total of three thermistors 33 respectively arranged at the center and both end portions in the lengthwise direction D1, the number of thermistors may be one or more.

<Effect of Present Exemplary Embodiment>

Figure 4:
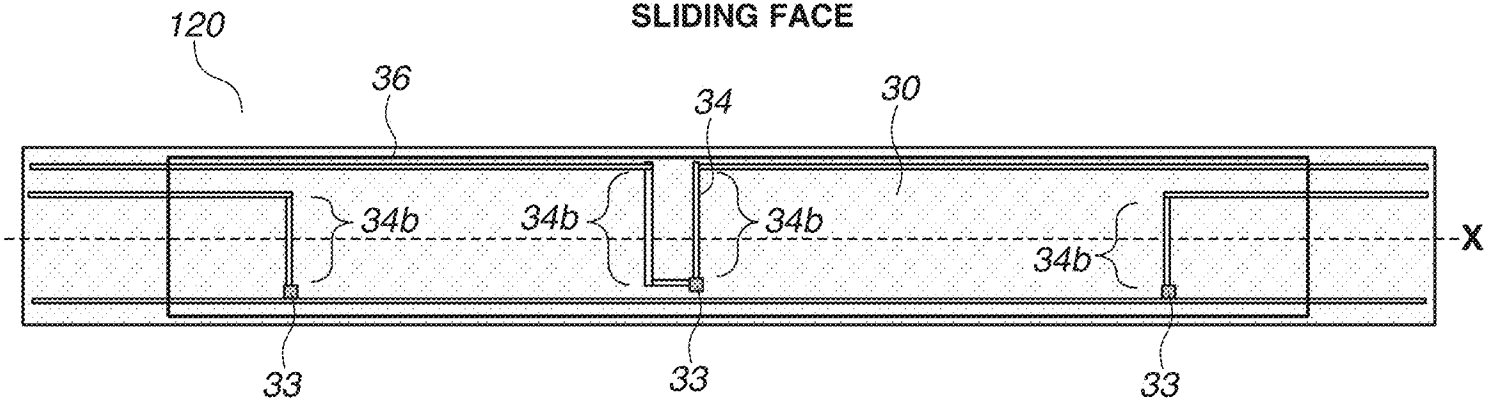
FIG. 4 is a diagram illustrating a configuration of a heater according to a comparison example.

A comparison example as a comparison target of the present exemplary embodiment will be described. FIG. 4 is a diagram illustrating a sliding face side of a heater 120. Since the conductive line 34 includes areas 34*b* that are in parallel with the widthwise direction D2, a regional step is generated on a part of a surface of the heater 120 (i.e., a surface of the protection layer 36) in the lengthwise direction D1. A height of the step in the comparison example (i.e., a step in a thickness direction of the heater 120) is 20 μm. In addition, the back face side of the heater 120 of the comparison example is similar to the back face side illustrated in FIG. 3A of the first exemplary embodiment.

An effect of the present exemplary embodiment was verified under the following condition. First, a normal paper and a glossy paper were prepared as recording materials P. A normal paper "HP Laser Jet 90 g" and a glossy paper "HP Brochure Paper 200 g" were used. Then, unfixed toner images were respectively formed on the normal paper and the glossy paper. Then, fixing processing was executed on these recording materials P by the fixing device 7 on which the heater 12 of the present exemplary embodiment was mounted. Similarly, fixing processing was executed on these recording materials P by a fixing device on which the heater 120 of the comparison example was mounted. A toner image fixed by the fixing device 7 of the present exemplary embodiment and a toner image fixed by the fixing device of the comparison example were compared to each other. In addition, the conveyance speed was set to 300 mm/s when fixing processing was executed on the normal paper, and the conveyance speed was set to 75 mm/s when fixing processing is executed on the glossy paper. Both of the control target temperatures of the heaters 12 and 120 were set to 160° C.

Figure 5:
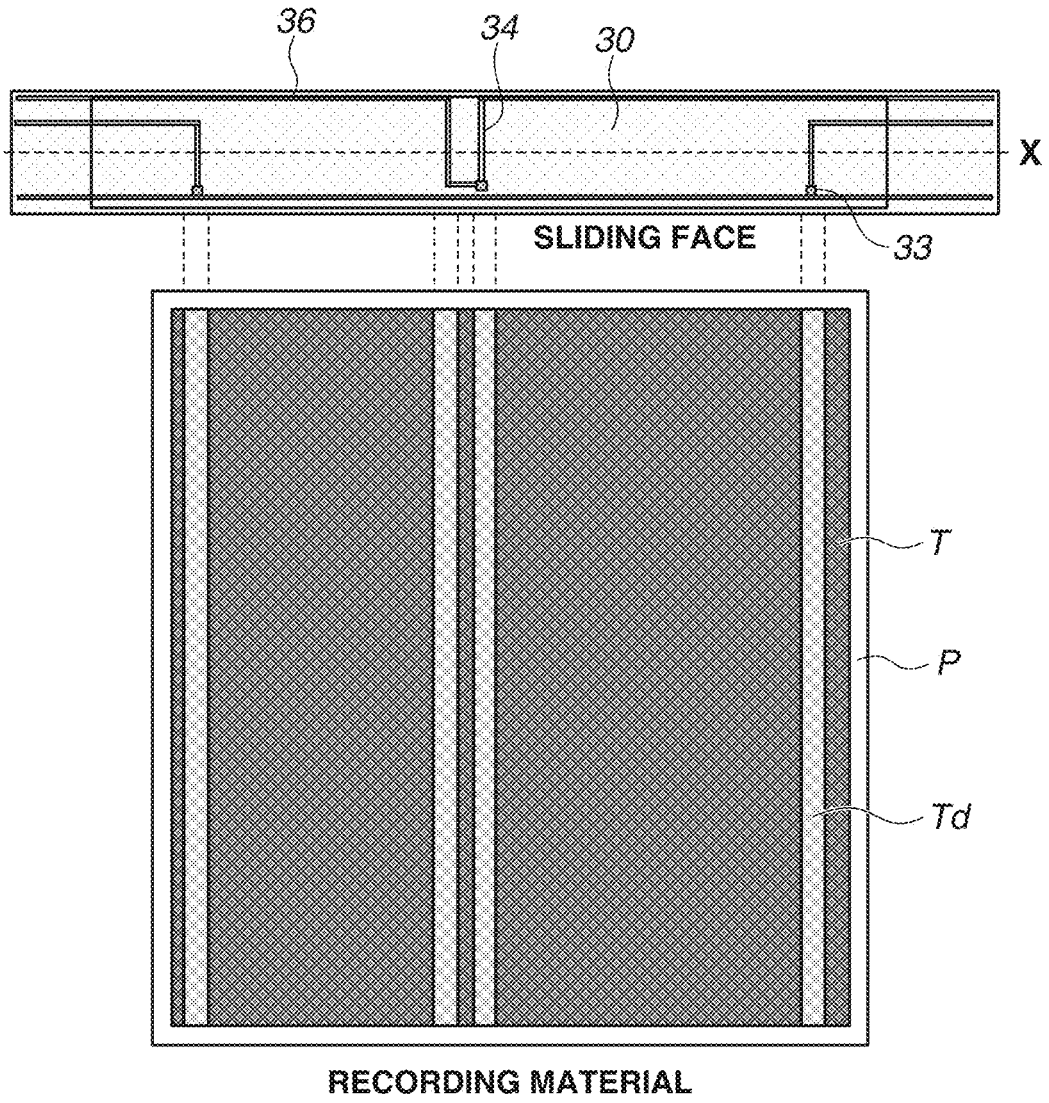
FIG. 5 is a diagram illustrating a position where an image defect occurs.

The result is illustrated in a table 1. Although an image defect occurred in both of the normal paper and the glossy paper when the heater 120 of the comparison example was used, favorable fixed images were obtained across the entire lengthwise area when the heater 12 of the present exemplary embodiment was used. In the comparison example, as illustrated in FIG. 5, a negative effect in which a toner image T was fixed insufficiently or generation of a gloss streak Td caused by lowering of glossiness occurred at a position corresponding to the areas 34*b* (see FIG. 4) where the conductive line 34 is in parallel with the widthwise direction.

TABLE 1

| Configuration of Heater | Image on Normal Paper | Image on Glossy Paper |
|---|---|---|
| Configuration of Present Exemplary Embodiment | Good | Good |
| Configuration of Conventional Example | Fixing Failure | Gloss Streak |

As described above, occurrence of the image defect can be suppressed by using the heater according to the present exemplary embodiment. A reason for the above result will be described below.

A reason for the image defect occurring in the comparison example is that the heater locally has an area where heat and pressure applied to the toner image become insufficient, at a step portion on the heater sliding face (a surface of the protection layer) generated by the conductive line 34. In the present exemplary embodiment, because the conductive line 34 is formed in an inclined direction, the step will not be intensively generated on a part of a lengthwise area on the sliding face side, so that insufficiency of heat and pressure in a local area described in the comparison example does not occur. As a result, the image defect does not occur because fixability of toner becomes substantially uniform in the entire lengthwise area.

Further, in order to confirm a range of the effect of the present exemplary embodiment, an experiment was conducted by changing the arrangement of the conductive line 34. As illustrated in FIG. 3B, with respect to a parallel line drawn in parallel with the lengthwise direction of the heater at a central position X in the widthwise direction of the substrate 30, an angle formed between the parallel line and the conductive line 34 formed in an inclined manner was defined as an angle A, and images fixed by changing the angle A were compared to each other. With respect to "Configuration of Present Exemplary Embodiment" in the above table 1, an angle A was set to 45° (angle A=45°).

TABLE 2

| Angle A | Image on Normal Paper | Image on Glossy Paper |
|---|---|---|
| A = 45° | Good | Good |
| A = 60° | Good | Good |
| A = 75° | Minor Fixing Failure | Minor Gloss Streak |

As illustrated in the table 2, an image defect did not occur when the angle A was 45° or 60°. The configuration became similar to that of the heater 120 described in the comparison example when the angle A was increased to 75°. Therefore, a slight image defect occurred although the image defect was less critical than that of the comparison example.

According to the result obtained in the present exemplary embodiment, it was found that an image defect is less likely to occur if the conductive line 34 is formed and arranged at an angle A of 60° or smaller. However, the condition such as "angle A=60°" depends on the type of the film, the thickness of the conductive line 34, and a type or a conveyance speed of the recording material, and thus the condition cannot be determined uniformly. However, as described above, if the angle A is set to be smaller than 90°, the step on the sliding face side may not be intensively generated in a part of a lengthwise area. Accordingly, providing an area that is inclined in both of the lengthwise direction and the widthwise direction of the substrate 30 without providing an area that is in parallel with the widthwise direction thereof is effective in suppressing occurrence of the image defect.

Variation Example 1

Figure 6:
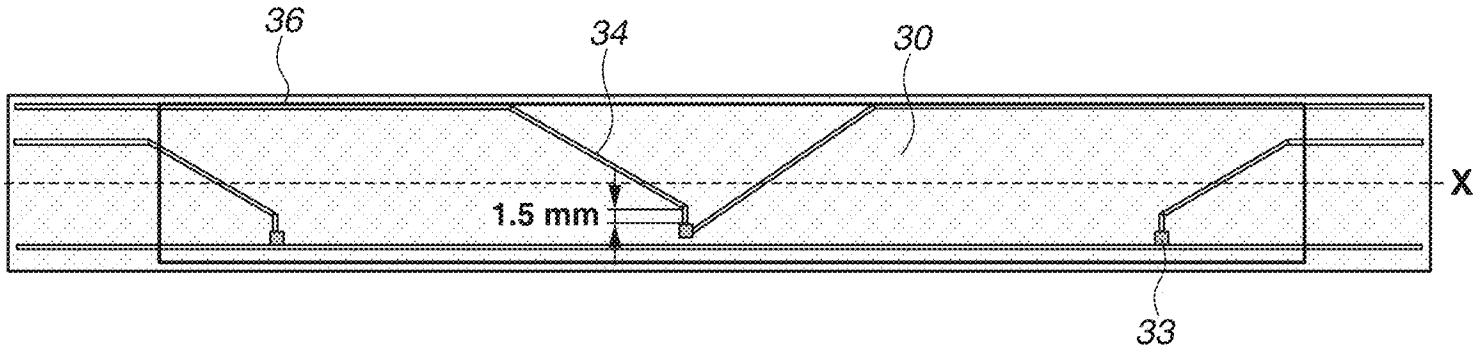
FIG. 6 is a diagram illustrating a configuration of a heater according to a variation example 1 of the first exemplary embodiment.

FIG. 6 is a diagram illustrating a heater as a variation example 1 of the present exemplary embodiment. In FIG. 6, although an area that is in parallel with the widthwise direction also exists, an image defect is less likely to occur if this area is small in length. In the present exemplary embodiment, an image defect did not occur when a length of an area that is in parallel with the widthwise direction is 1.5 mm or less. Similar to the condition of the angle A, although the above condition is not determined uniformly, it is preferable that a length of the conductive line 34 formed in the widthwise direction be shorter.

Variation Example 2

Figure 7:
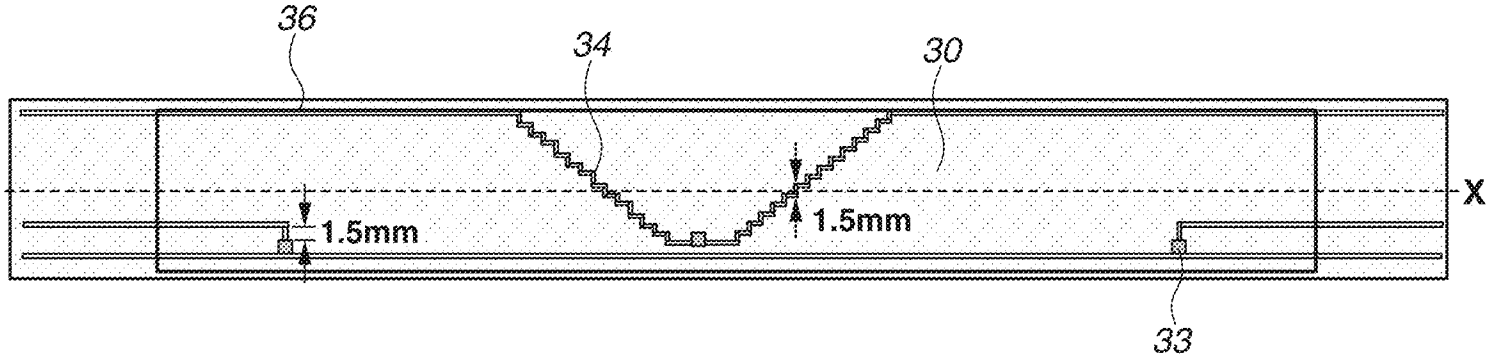
FIG. 7 is a diagram illustrating a configuration of a heater according to a variation example 2 of the first exemplary embodiment.

Now, a variation example 2 of the present exemplary embodiment will be described. As illustrated in FIG. 7, the conductive line 34 of the heater in the variation example 2 includes an area that is in parallel with the lengthwise direction of the substrate 30 and an area that is in parallel with the widthwise direction of the substrate 30. Then, the respective areas that are in parallel with the lengthwise direction and the widthwise direction are alternately connected to each other, so that the conductive line 34 is formed into a step-like shape. In this variation example, an image defect is less likely to occur if a length of an area that is in parallel with the widthwise direction is shorter (i.e., in the present exemplary embodiment, 1.5 mm or less).

Variation Example 3

Figure 8:
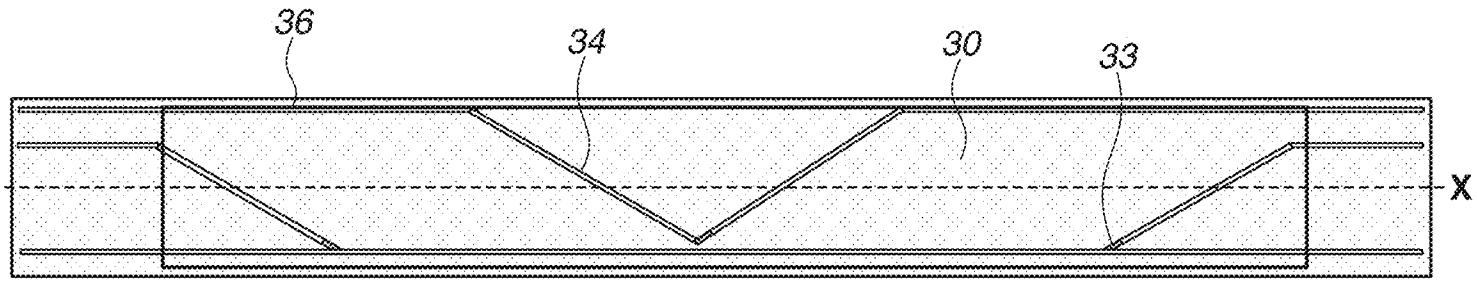
FIG. 8 is a diagram illustrating a configuration of a heater according to a variation example 3 of the first exemplary embodiment.

As illustrated in FIG. 8, the thermistor 33 as a temperature detection element may have a shape that is not in parallel with the lengthwise direction as well as the widthwise direction. If the thermistor 33 has an area that is in parallel with the widthwise direction, there is a possibility that an image defect occurs similarly with the case where the conductive line 34 is extended in parallel with the widthwise direction. This variation example is more preferable in that a step can be prevented from being intensively generated on a part of the lengthwise area including a portion of the thermistor 33, so that an image defect can be suppressed from occurring.

A second exemplary embodiment of the present invention will be described. The present exemplary embodiment is characterized in that an image defect is suppressed by reducing a step itself generated by the conductive line.

A basic configuration and operation of the fixing device 7 are similar to those described in the first exemplary embodiment. Only a shape on a side of the sliding face of the heater 12 mounted on the fixing device 7 is different from that of the first exemplary embodiment.

<Configuration of Heater>

Figure 9A:
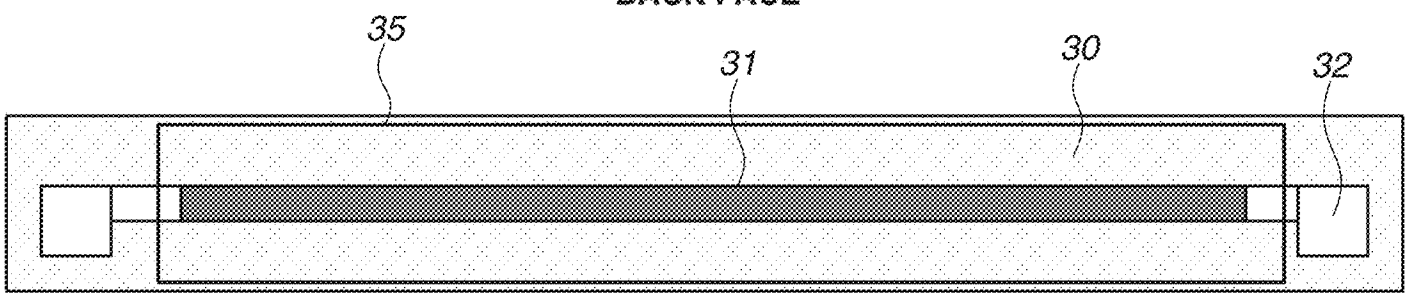
FIGS. 9A and 9B are diagrams illustrating a configuration of a heater according to a second exemplary embodiment.
Figure 9B:
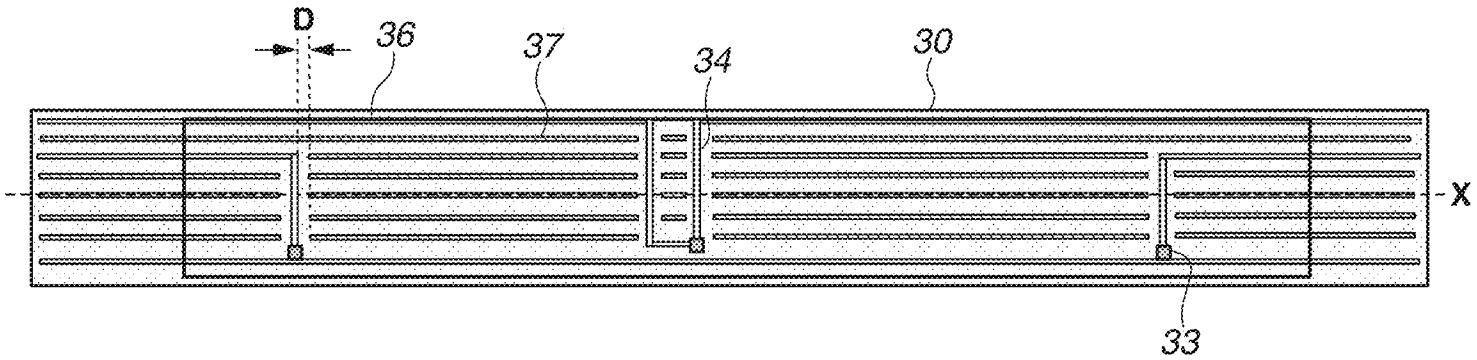

A configuration of the heater of the present exemplary embodiment will be described with reference to FIGS. 9A and 9B. FIG. 9A is a diagram illustrating a back face side of the substrate 30, having a shape similar to the shape described in the first exemplary embodiment. FIG. 9B is a diagram illustrating a sliding face side thereof, on which the thermistor 33 and the conductive line 34 are formed similarly with the configuration illustrated in FIG. 4. However, in the present exemplary embodiment, a convex portion 37 electrically insulated from the conductive line 34 is arranged on a side of the substrate 30 on which the conductive line 34 is arranged. A material of the convex portion 37 of the present exemplary embodiment is Ag. The thermistor 33, the conductive line 34, and the convex portion 37 are covered with the protection layer 36 made of a glass material.

A step generated in the comparison example of the first exemplary embodiment is reduced by the convex portion 37. In the present exemplary embodiment, the convex portion 37 is formed at a position where a step has a height of 10 μm or less. A reason for this will be described below.

<Effect of Present Exemplary Embodiment>

Figure 11A:
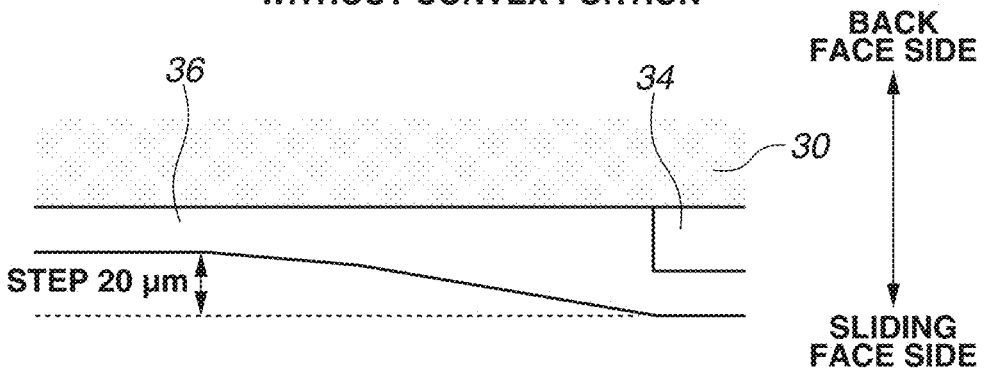
FIGS. 11A, 11B, and 11C are diagrams each illustrating an enlarged view near a conductive line of a heater according to a second exemplary embodiment.
Figure 11B:
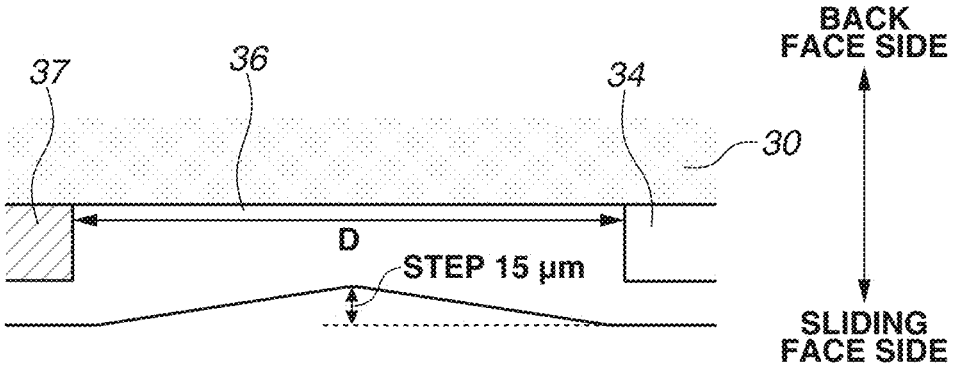
Figure 11C:
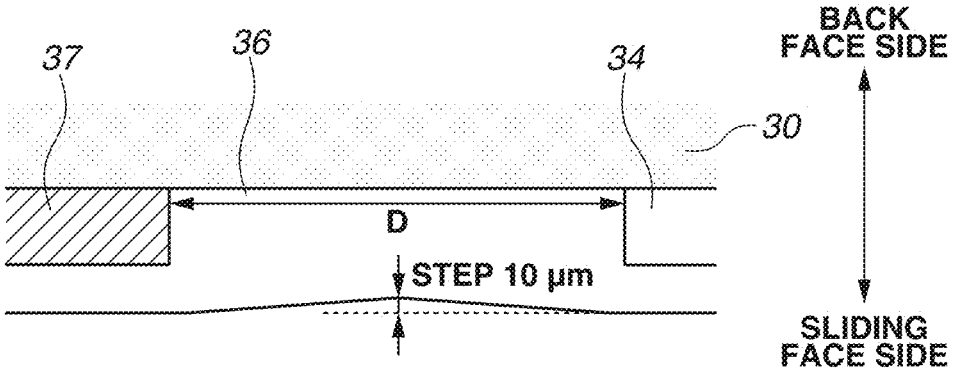

An effect of the present exemplary embodiment will be described. The experiment was conducted with the same condition as the condition of the first exemplary embodiment by using the heater according to the present exemplary embodiment as a heater to be mounted on the fixing device, and the present exemplary embodiment was compared to the comparison example. Further, a distance D between the conductive line and the convex portion was changed in order to confirm a range of the effect of the present exemplary embodiment, and fixed images were evaluated. As illustrated in the enlarged diagrams of the sliding face of the heater in FIGS. 11A to 11C, a step having a height of 20 μm was generated in the comparison example, a step having a height of 15 μm was generated when the distance D between the conductive line and the convex portion is 0.75 mm (D=0.75 mm), and a step having a height of 10 μm was generated when the distance D between the conductive line and the convex portion was 0.50 mm (D=0.50 mm).

The result is illustrated in a table 3. The result of the comparison example is the same as the result obtained in the first exemplary embodiment. When the step was reduced to 15 μm, a fixing failure did not occur in the normal paper although a minor gloss streak was generated. On the other hand, if the step was reduced to 10 μm, an image defect did not occur. If the step was 10 μm or less, an area where applied heat and pressure is not sufficient was reduced, so that fixability is obtained sufficiently.

TABLE 3

| Configuration of Heater | Image on Normal Paper | Image on Glossy Paper |
|---|---|---|
| Configuration of Step 10 μm | Good | Good |
| Configuration of Step 15 μm | Good | Minor Gloss Streak |
| Configuration of Conventional Example | Fixing Failure | Gloss Streak |

According to the above-described result, an image defect can be suppressed if the convex portion is formed to reduce the step on the surface of the protection layer to 10 μm or less. In other words, an image defect can be suppressed by setting the step generated by the protection layer on the conductive line 34, the protection layer on the convex portion 37, and the protection layer positioned between the conductive line 34 and the convex portion 37 to be 10 μm or less. Since the conductive line 34 or the convex portion 37 exists in the wide area on the heater, it is advantageous that thermal resistance becomes substantially uniform. Therefore, the present exemplary embodiment is more preferable than the first exemplary embodiment.

Further, in the present exemplary embodiment, although the same material (Ag) is used for the conductive line 34 and the convex portion 37, different materials may be used therefor. However, by using the same material, occurrence of an image defect can be suppressed more easily because the thermal resistance of the conductive line 34 and the convex portion 37 becomes substantially uniform as described above.

Figure 10:
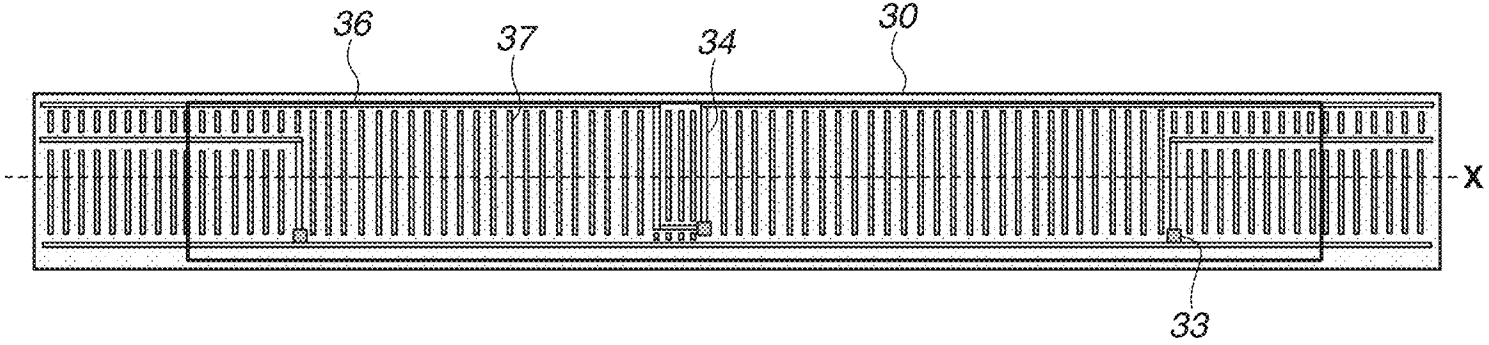
FIG. 10 is a diagram illustrating a configuration of a heater according to another example of the second exemplary embodiment.

Further, in FIG. 9B, the convex portion 37 is formed in parallel with the lengthwise direction of the heater. However, even in a case where the convex portion 37 is formed in parallel with the widthwise direction of the heater as illustrated in FIG. 10, an effect similar to the effect obtained in the above-described exemplary embodiment can be obtained by reducing the step.

Variation Example

Figure 12:
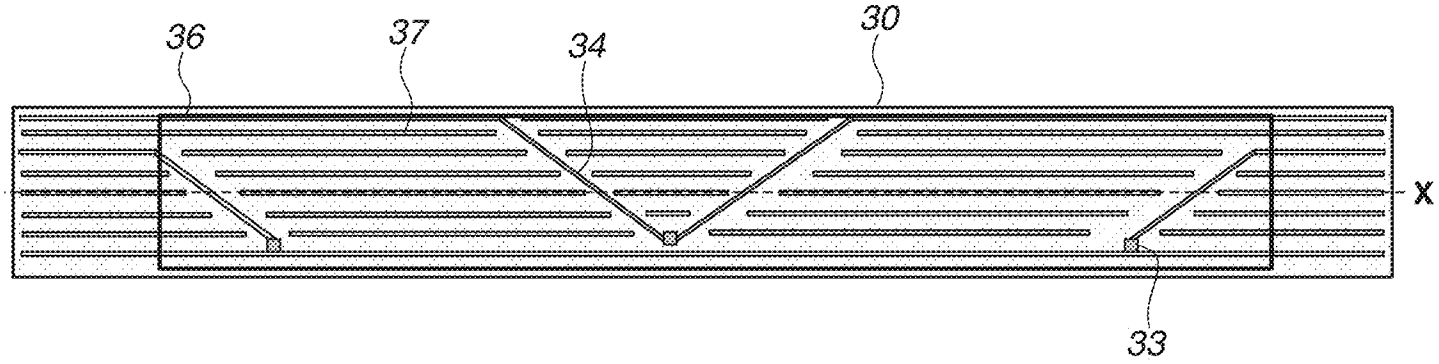
FIG. 12 is a diagram illustrating a configuration of a sliding face of a heater according to a variation example of the second exemplary embodiment.

As a variation example of the present exemplary embodiment, as illustrated in FIG. 12, a configuration may be such that the conductive line 34 is formed on the substrate 30 in the inclined direction, and the convex portion 37 insulated from the conductive line 34 may be formed thereon. This variation example is more preferable because the step itself can be reduced by the convex portion 37 while a state in which the step is intensively generated on a part of the lengthwise area can be prevented by the conductive line 34 formed in the inclined direction as described in the first exemplary embodiment. Further, the convex portion 37 may be formed on the heater having the conductive line that is formed into a shape illustrated in the variation examples of the first exemplary embodiment.

Figure 13:
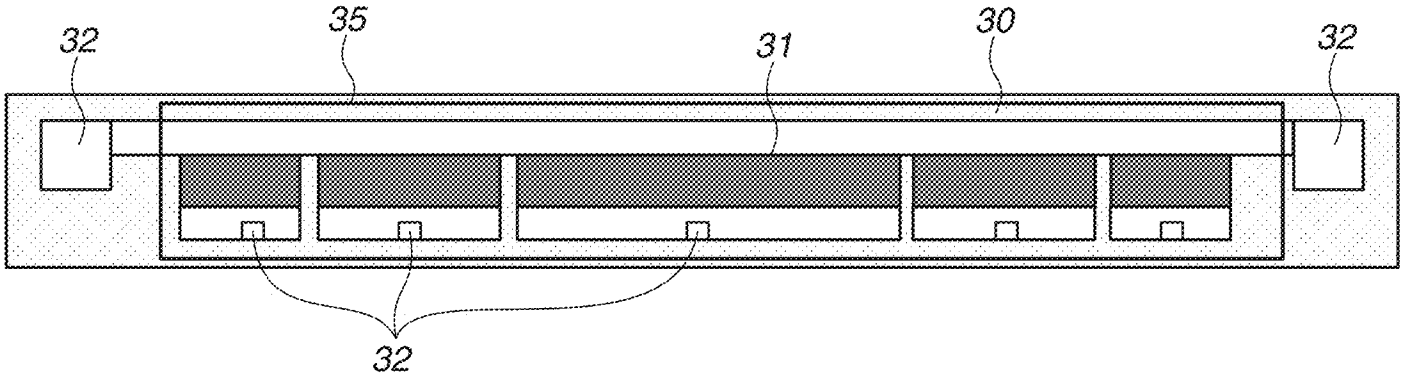
FIG. 13 is a diagram illustrating a configuration of a back face of a heater according to a variation example of the second exemplary embodiment.

In addition, a shape of the heat generating resistor 31 is not limited to the shape employed in the present exemplary embodiment or the variation examples. For example, as illustrated in FIG. 13, a plurality of heat generating resistors 31 may be arranged in the lengthwise direction, and temperatures thereof may be controlled independently. The heat generating resistors 31 illustrated in FIG. 13 are divided into five areas, and each of the areas can be controlled independently. In a case where the temperature at each area is controlled independently, a thermistor needs to be arranged at each of the areas, and the number of conductive lines connected to the thermistor has to be increased. Therefore, an effect of the present invention can be obtained more efficiently.

Next, a heater according to a third exemplary embodiment will be described.

<Configuration of Heater 12>

A configuration of a heater according to the third exemplary embodiment will be described with reference to FIGS. 14A and 14B. A heater 12 includes a substrate 30 and a heat generation element 31 arranged on the substrate 30. The heater 12 further includes temperature detection elements 331 to 333 arranged on a face opposite to the face of the substrate 30 on which the heat generation element 31 is arranged, and a conductive line 34 electrically connected to the temperature detection elements 331 to 333, arranged on a face opposite to the face of the substrate 30 on which the heat generation element 31 is arranged.

Figure 14A:
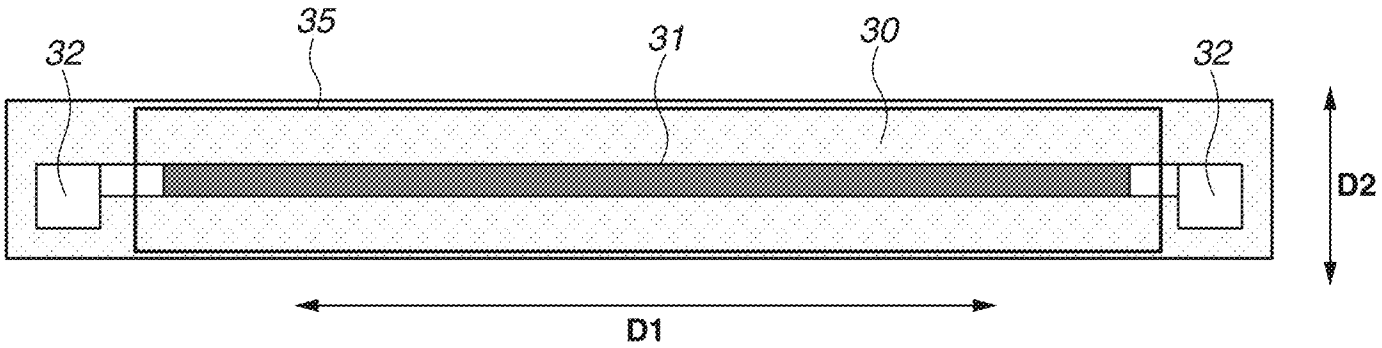
FIGS. 14A and 14B are diagrams illustrating a heater according to a third exemplary embodiment.

FIG. 14A is a diagram illustrating a back face side of the heater 12, i.e., a face on the opposite side of the sliding face of the heater 12 sliding with the film 11. The heat generating resistor (heat generation element) 31 and an electrode 32 are formed on the alumina substrate 30 through screen printing, and the heat generating resistor 31 is covered with a first protection layer 35 made of a glass material. A connector (not illustrated) is connected to the electrode 32, and the heat generating resistor 31 receives the power supplied from a power source to generate heat. In addition, a ceramic material such as aluminum nitride or a metallic material with a surface thereof covered with an insulation layer may be used as a material of the substrate 30.

Figure 14B:
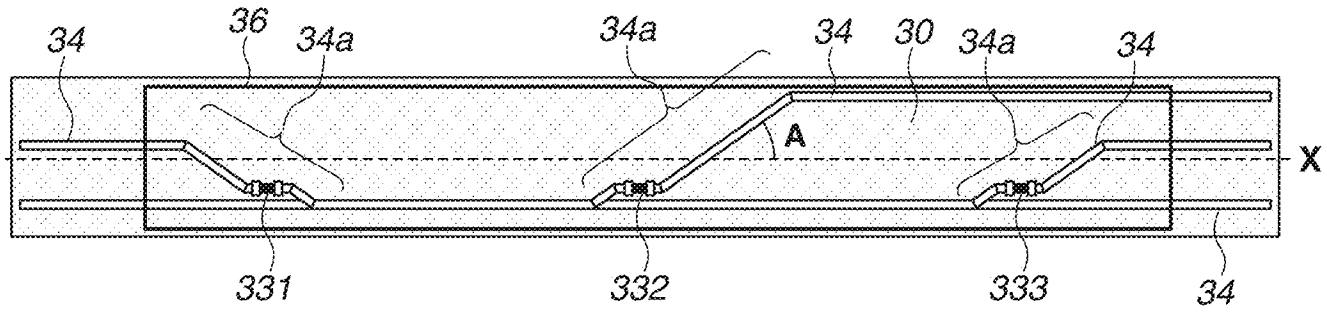

FIG. 14B is a diagram illustrating a sliding face side of the heater 12. Thermistors 331 to 333 as temperature detection elements and a conductive line 34 are formed on the sliding face of the heater 12 through screen printing. Since the conductive line 34 is connected to a control circuit 9 within the image forming apparatus via a connector (not illustrated), temperatures detected by the thermistors 331 to 333 can be transmitted to a control circuit 9. The conductive line 34 includes areas 34*a* that is inclined in both of a lengthwise direction D1 (i.e., the lengthwise direction of the heater 12) and a widthwise direction D2 of the substrate 30 (i.e., the widthwise direction of the heater 12). By forming the conductive line 34 in the inclined direction, occurrence of an image defect can be suppressed. In addition, a line X represents a center in the widthwise direction D2 of the heater 12. An angle A is an inclination angle of the area 34*a* with respect to the direction D1. Further, the direction D2 is a conveyance direction of a recording material in the fixing device.

In a middle of the area 34*a* of the conductive line 34 arranged in the inclined direction, each of thermistors 331, 332, and 333 is arranged in parallel with the direction D1, so that a lengthwise direction of the thermistor is in parallel with the direction D1. A reason for arranging the thermistors 331 to 333 in the above-described state is to prevent occurrence of an image defect caused by a step generated at connection portions of the thermistors 331, 332, and 333 and the conductive line 34. The details will be described below. Further, as illustrated in FIG. 15A, each of the thermistors 331 to 333 is formed into a shape having a long side and a short side when the heater 12 is viewed in a direction perpendicular to the sliding face.

The thermistors 331 to 333 and the conductive line 34 are also covered with a second protection layer 36 made of glass. The second protection layer 36 also plays a role of protecting the thermistors 331 to 333 and the conductive line 34 from abrasion caused by friction with respect to the film 11. Therefore, a glass material with abrasion resistance higher than that of the first protection layer 35 is used. In addition, Ag/Pd is used as a material of the heat generating resistor 31, and Ag is used as a material of the electrode 32 and the conductive line 34.

A connection portion of the thermistor 332 and the conductive line 34 will be described with reference to FIGS. 15A to 15C. FIG. 15A is an enlarged diagram illustrating a vicinity of the thermistor 332, and widths of both of the thermistor 332 and the conductive line 34 are a width W1. The width W1 is 0.5 mm. However, the width of the conductive line 34 at a portion connected with the thermistor 332 is a width W2 that is wider than the width W1. With this configuration, occurrence of an image defect caused by a step generated at each connection portion of the thermistor 332 and the conductive line 34 can be prevented. Details thereof will be described below. The width W2 is 0.7 mm. In the present exemplary embodiment, the thermistor 332 is connected with the conductive line 34 to overlap the conductive line 34 from the above. Shaded portions in FIG. 15A express overlapping portions OLP of the conductive line 34 and the thermistor 332.

Figure 15A:
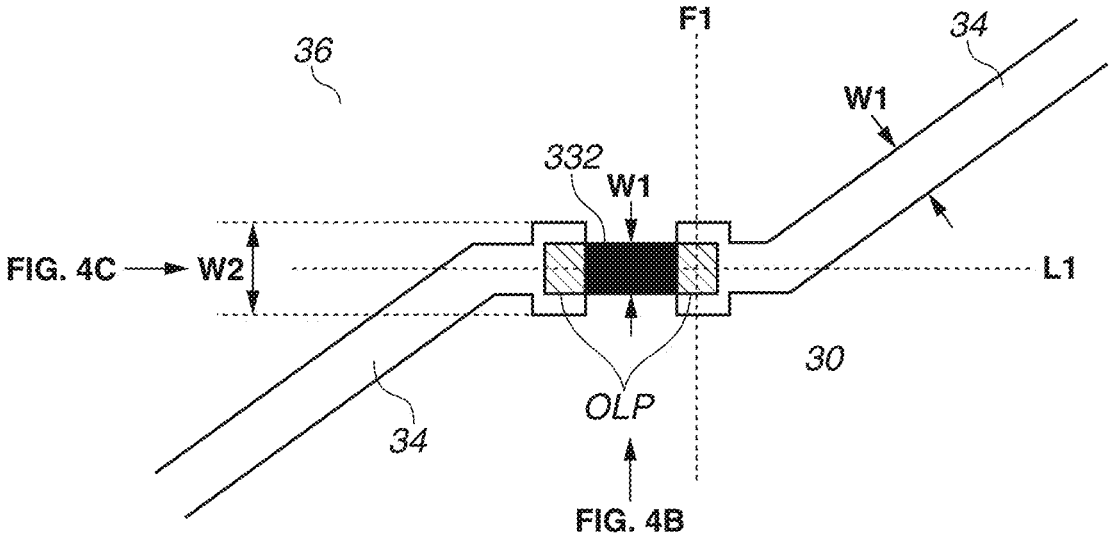
FIGS. 15A, 15B, and 15C are diagrams illustrating a connection portion of a thermistor and a conductive line according to the third exemplary embodiment.
Figure 15B:
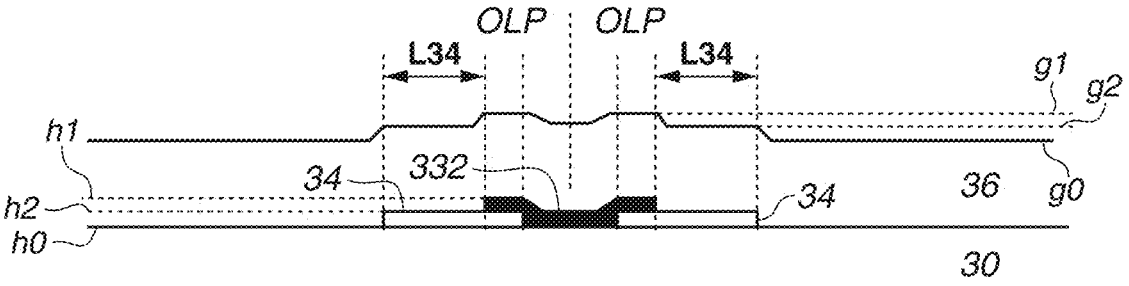

FIG. 15B is a cross section diagram taken along a line L1 in FIG. 15A. A symbol "h0" represents a height of the substrate 30, a symbol "h1" represents a height of the overlapping portion OLP of the conductive line 34 and the thermistor 332 (i.e., first height), and a symbol "h2" represents a height of the conductive line 34 (i.e., second height).

Further, a symbol "g0" represents a height of the second protection layer 36 at a portion where nothing is arranged on the substrate 30, a symbol "g1" represents a height of the second protection layer 36 on the overlapping portion OLP, and a symbol "g2" represents a height of the second protection layer 36 on the conductive line 34. Further, the thermistor 332 and the conductive line 34 are set to have the same thickness of 7 μm. Therefore, respective heights satisfies the conditions "h1−h0=14 μm" and "h2−h0=7 μm". Further, a difference in heights g0 to g2 (height of the step) of the second protection layer 36 is substantially the same as the difference in heights h0 to h2 (height of the step).

In the cross-sectional face L1 in FIG. 15B, the conductive line 34 as a gradient moderating portion having a height (second height) h2 exists at a position between the substrate 30 having the height h0 and the overlapping portion OLP having the height (first height) h1. Therefore, variation in height from the surface of the substrate 30 to the surface of the overlapping portion OLP becomes moderate, so that variation in height of the surface of the second protection layer 36 in the direction D1 also becomes moderate. In addition, the thickness of the second protection layer 36 is set to 20 μm.

As illustrated in FIG. 15B, in the cross-sectional face at the line L1, an area in which the height varies from the height h0 to the height h1 without passing the height h2 does not exist in the vicinity of the thermistor 332. In a case where the height varies from the height h0 to the height h1, the conductive line 34 having the second height h2 always exists in the space between the substrate 30 and the thermistor 332 as a gradient moderating portion. In the heater 12 according to the present exemplary embodiment, a structure of a cross-sectional face at the line L1 in the areas in vicinities of the thermistor 331 and 333 are similar to the structure in the area in the vicinity of the thermistor 332. In addition, not all of the structures of the cross-sectional faces at the line L1 in the vicinities of the thermistors 331 to 333 have to be the above-described structure. A structure in a vicinity of at least one thermistor where variation in height of the surface of the second protection layer 36 has to be suppressed only needs to have the above-described structure. Further, in the present exemplary embodiment, a length L34 in the direction D1 of a portion of the conductive line 34 serving as a gradient moderating portion, which excludes a portion corresponding to the overlapping portion OLP, is 0.5 mm or longer.

Figure 15C:
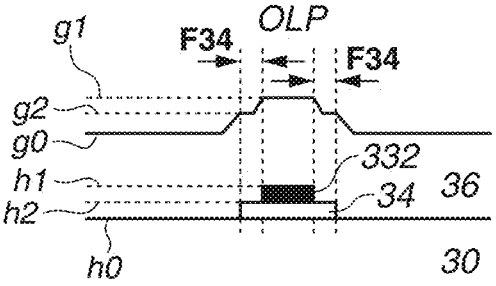

FIG. 15C is a cross section diagram taken along a line F1 in FIG. 15A. As described above, the width W2 of the connection portions of the conductive line 34 and the thermistor 332 is wider than the width W1. Therefore, at the cross-sectional face at the line F1, an area in which the height varies from the height h0 to the height h1 without passing through the height h2 does not exist in the vicinity of the thermistor 332. In a case where the height varies from the height h0 to the height h1, as a gradient moderating portion, the conductive line 34 having the second height h2 always exists in the space between the substrate 30 and the thermistor 332. Therefore, variation in height of the surface of the second protection layer 36 in the direction D2 also becomes moderate.

In the heater 12 according to the present exemplary embodiment, a structure of the cross-sectional face at the line F1 in the area in the vicinities of the thermistors 331 and 333 is similar to the structure at the line F1 in the area in the vicinity of the thermistor 332. In addition, not all of the structures of the cross-sectional faces at the line F1 in the vicinities of the thermistors 331 to 333 have to be the above-described structure. A structure in a vicinity of at least one thermistor where variation in height of the surface of the second protection layer 36 has to be suppressed only needs to have the above-described structure. Further, in the present exemplary embodiment, a length F34 in the direction D2 of the conductive line 34 serving as a gradient moderating portion (excluding a portion corresponding to the overlapping portion OLP) is 0.1 mm or longer.

In the present exemplary embodiment, the heater 12 having a total of three thermistors has been described. However, even if the number of thermistors included in the heater is one, or four or more, variation in height of the surface of the second protection layer 36 can be also mitigated by arranging the above-described gradient moderating portion.

Next, a heater according to a comparison example will be described with reference to FIG. 16. The heater of the comparison example 1 illustrated in FIG. 16 also includes three thermistors. The three thermistors are arranged at same positions as positions in the heater 12 according to the third exemplary embodiment, and a thickness of the thermistor and a thickness of the conductive line are also same as the thicknesses respectively in the third exemplary embodiment.

Figure 16:
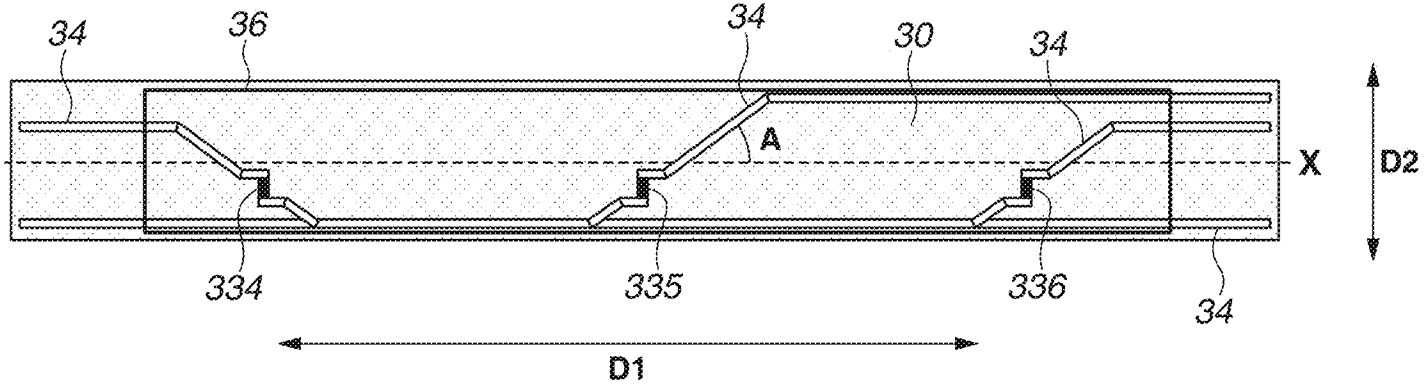
FIG. 16 is a diagram illustrating a heater according to a comparison example.

Thermistors 334, 335, and 336 illustrated in FIG. 16 are arranged to place the long sides thereof to be in parallel with the direction D2. Further, each of the thermistors 334 to 336 is connected to the conductive line 34, so that two connection positions of each of the thermistors 334 to 336 and the conductive line 34 are connected and arranged in a direction parallel to the direction D2.

Figure 17A:
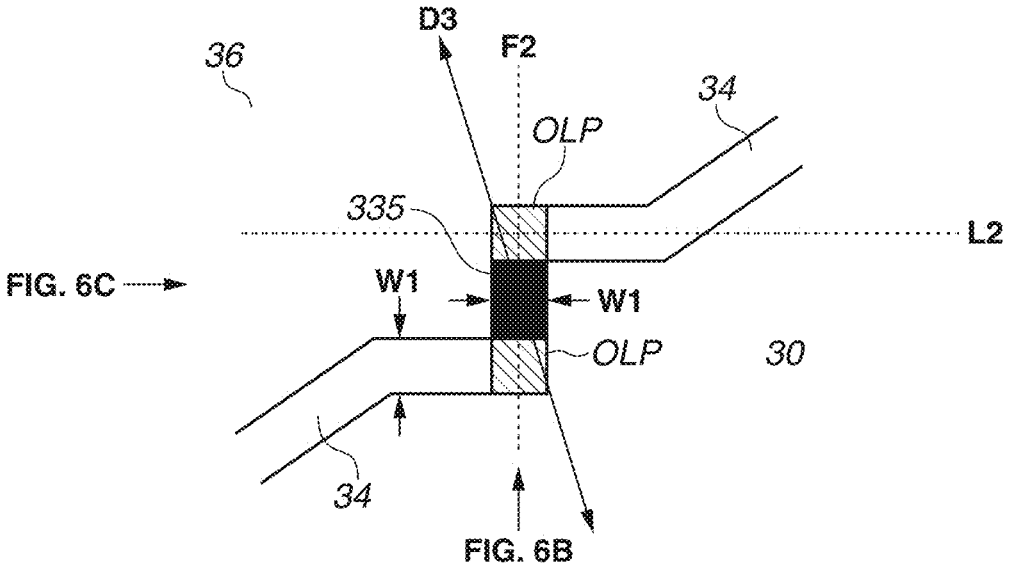
FIGS. 17A, 17B, and 17C are diagrams illustrating a connection portion of a thermistor and a conductive line according to a comparison example.
Figure 17B:
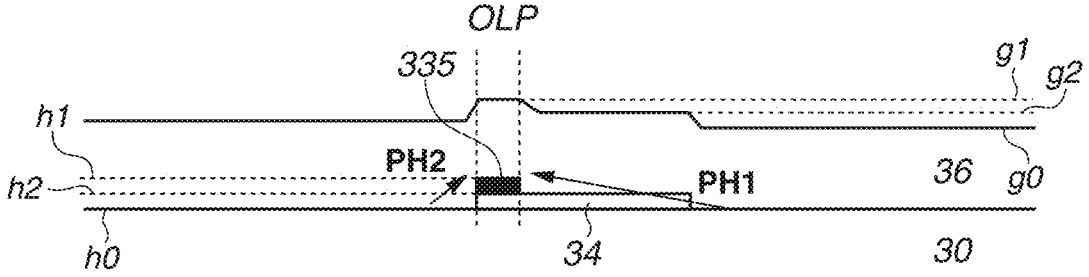
Figure 17C:
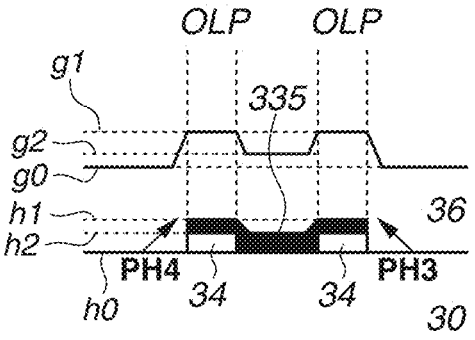

Next, connection portions of the thermistor 335 and the conductive line 34 in the comparison example 1 will be described with reference to FIGS. 17A, 17B, and 17C. FIG. 17A is a diagram illustrating a proximal enlarged view of the thermistor 335 of the heater in the comparison example 1, FIG. 17B is a cross section diagram taken along a line L2 in FIG. 17A, and FIG. 17C is a cross section diagram taken along a line F2 in FIG. 17A. The widths of both of the thermistor 335 and the conductive line 34 are the width W1.

A path PH1 and a path PH2 illustrate paths through which a height varies from the height h0 of the substrate 30 to the height h1 of the overlapping portion OLP. Since the conductive line 34 as a gradient moderating portion having the second height h2 exists in the path PH1, the height moderately varies from the height h0 of the substrate 30 to the height h1 of the overlapping portion OLP. However, in the path PH2, since the gradient moderating portion does not exist, the height directly varies from the height h0 of the substrate 30 to the height h1 of the overlapping portion OLP. Therefore, the height varies with a steep gradient. Therefore, on a surface of the second protection layer 36 corresponding to the path PH2, the height steeply varies from the height g0 corresponding to the height h0 of the substrate 30 to the height g1 corresponding to the height h1 of the overlapping portion OLP. Therefore, a fixing failure or a gloss streak caused by a magnitude of irregularity on the surface of the second protection layer 36 is likely to occur.

A path PH3 and a path PH4 also illustrate paths through which a height varies from the height h0 of the substrate 30 to the height h1 of the overlapping portion OLP. Since the gradient moderating portion does not exist in each of the paths PH3 and PH4, the height directly vary from the height h0 of the substrate 30 to the height h1 of the overlapping portion OLP, so that the height varies with a steep gradient. According to the magnitude of the gradient, the height steeply varies from the height g0 corresponding to the height h0 of the substrate 30 to the height g1 corresponding to the height h1 of the overlapping portion OLP on the surface of the second protection layer 36 corresponding to the paths PH3 and PH4. Therefore, a fixing failure or a gloss streak caused by a magnitude of irregularity on the surface of the second protection layer 36 is likely to occur.

As described above, in the comparison example 1, there is an area, which does not have the gradient mitigation portion, where the height varies from the height h0 to the height h1 without having the height h2 in both of the directions D1 and D2. Further, in the heater of the comparison example 1, there is an area where the gradation mitigation portion does not exist in a direction other than the directions D1 and D2 on the face where the thermistor and the conductive line are arranged (e.g., direction D3 illustrated in FIG. 17A). On the other hand, in an area between the area having the height h0 and the area having the height h1 of the heater 12 of the third exemplary embodiment, a gradient moderating portion as an area having the height h2 exists in all of directions other than the directions D1 and D2 on the face where the thermistor and the conductive line are arranged.

An effect of the heater according to the present exemplary embodiment was verified under the following condition. A normal paper "HP Laser Jet 90 g" and a glossy paper "HP Brochure Paper 200 g" were used as the recording materials P. Toner images formed on the recording materials P were respectively heated and fixed onto the recording materials P by using the heaters according to the present exemplary embodiment and the comparison example, and the fixed images were compared to each other. A conveyance speed was set to 300 mm/s when the normal paper was used as the recording material P, and a conveyance speed was set to 75 mm/s when the glossy paper was used as the recording material P.

The result is illustrated in a table 4. Although an image defect occurred in both of the normal paper and the glossy paper when the heater of the comparison example 1 was used, favorable images were obtained across the entire area of the recording material P when the heater of the present exemplary embodiment was used.

Figure 18:
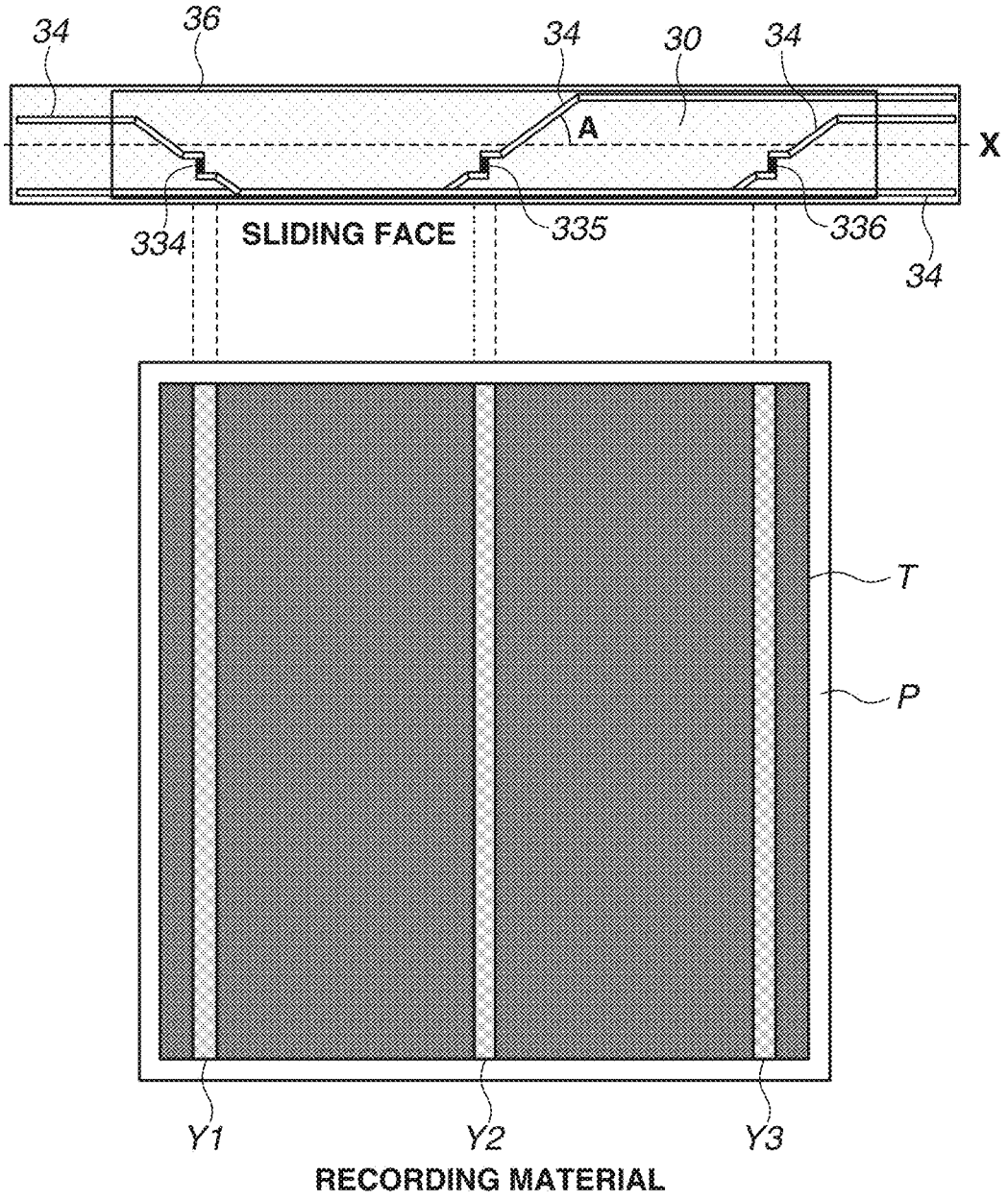
FIG. 18 is a diagram illustrating an image defect occurring in a comparison example.

In the comparison example 1, as illustrated in FIG. 18, a negative effect in which a toner image T was fixed insufficiently or generation of a gloss streak caused by lowering of glossiness occurred in the areas Y1, Y2, and Y3 corresponding to the arrangement positions of the thermistors 334, 335, and 336.

TABLE 4

| Configuration of Heater | Image on Normal Paper | Image on Glossy Paper |
|---|---|---|
| Configuration of Third Exemplary Embodiment | Good | Good |
| Configuration of Comparison Example 1 | Fixing Failure | Gloss Streak |

As described above, occurrence of an image defect can be suppressed by employing the configuration of the heater according to the present exemplary embodiment. A reason for the above result will be described below.

A reason for the image defect occurring in the comparison example is that the heater locally has an area where heat and pressure applied to the toner image become insufficient, because of a large step on the sliding face of the heater generated at an overlapping portion OLP of the conductive line of the thermistor.

As described above, in the present exemplary embodiment, the gradient moderating portion is always arranged in the directions D1 and D2, so that a large step is not generated in a periphery of the overlapping portion OLP of the conductive line and the thermistor. Therefore, as described above, generation of an area where heat and pressure applied to the toner image locally become insufficient can be suppressed. As a result, an effect of suppressing occurrence of an image defect can be obtained.

In addition, in the configuration of the apparatus of the present exemplary embodiment, it was confirmed that frequency of occurrence of an image defect was increased when the height of one step exceeded approximately 10 μm. In the first exemplary embodiment, an effect of suppressing the image defect can be obtained because a height of one step (h1−h2) is approximately 7 μm. Accordingly, it is preferable that the gradient moderating portion be arranged to make the step become 10 μm or less.

Figure 19A:
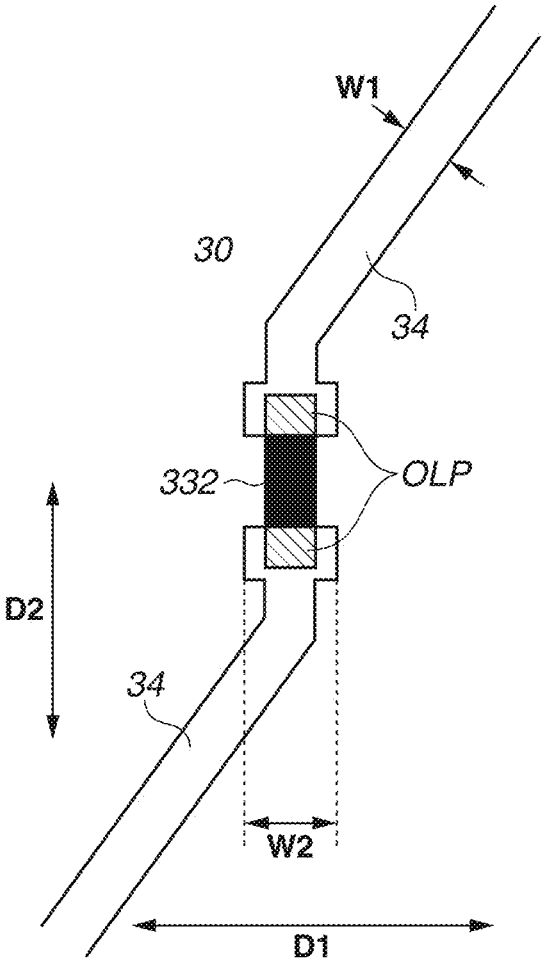
FIGS. 19A and 19B are diagrams illustrating a connection portion of a thermistor and a conductive line according to variation examples of the third exemplary embodiment.
Figure 19B:
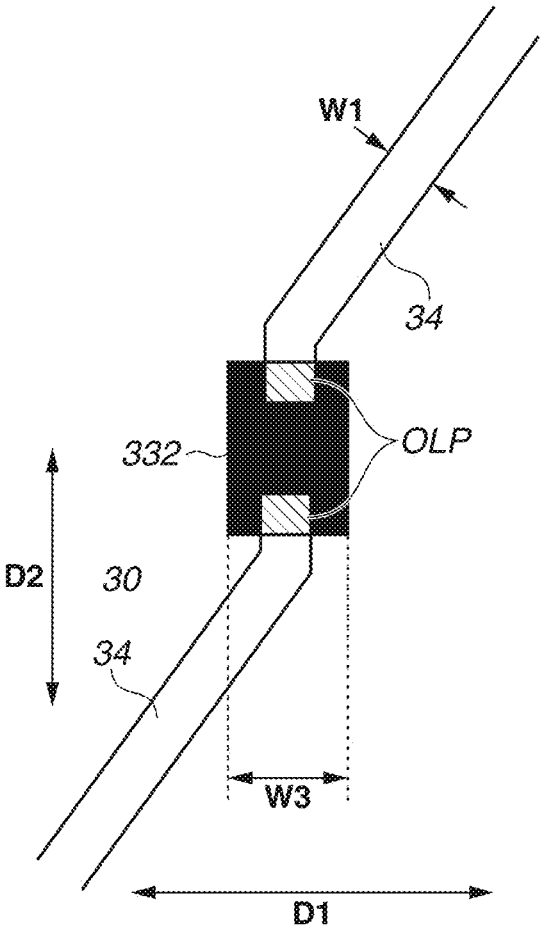

Next, a variation example of the present exemplary embodiment will be described. FIGS. 19A and 19B are diagrams illustrating two examples in each of which the thermistor and the conductive line are connected to each other in a direction different from the direction of the first exemplary embodiment by 90-degree.

Variation Example 1

A variation example 1 in FIG. 19A illustrates a configuration in which peripheries of the connection portions of the thermistor 332 and the conductive line 34 in the first exemplary embodiment is rotated by 90-degree.

A cross-sectional faces in the directions D1 and D2 including the overlapping portion OLP are reversed with those of the first exemplary embodiment, and the effects acquired from the respective cross-sectional faces are similar to those described in the third exemplary embodiment.

Variation Example 2

A relationship between the widths of the thermistor 332 and the conductive line 34 at the connection portion in the variation example 2 illustrated in FIG. 19B is different from those of the third exemplary embodiment or the variation example 1.

In the variation example 2, the width of the thermistor 332 is set to a width W3 that is wider than the width W1 of the conductive line 34. In this configuration, similar to the first exemplary embodiment and the variation example 1, the conductive line 34 functions as a gradient moderating portion in the conveyance direction. However, different from the third exemplary embodiment and the variation example 1, the thermistor 332 functions as a gradient moderating portion in the direction D1. An effect similar to the effect obtained in the third exemplary embodiment and the variation example 1 can be obtained because the thermistor 332 and the conductive line 34 have the same thickness.

In the above-described exemplary embodiments, a part of the conductive line 34 or the thermistor 332 functions as the gradient moderating portion. However, for example, an insulation member having the second height may be used as the gradient moderating portion.

As described above, the heater according to the present exemplary embodiment includes a substrate, a heat generation element arranged on the substrate, a temperature detection element arranged on the substrate, a conductive line connected to the temperature detection element, and a protection layer that covers the temperature detection element and the conductive line. This heater is used for a fixing device for fixing a toner image formed on a recording material onto the recording material. Then, an overlapping portion at which the temperature detection element and the conductive line overlap with each other is arranged at a connection portion of the temperature detection element and the conductive line. In a cross-sectional face of the heater parallel with the lengthwise direction, cut along a face passing through the temperature detection element, a gradient moderating portion having a step smaller than a step from a surface of the substrate to a surface of the overlapping portion is arranged at a position adjacent to the overlapping portion. Further, at a cross-sectional face of the heater parallel with the widthwise direction, cut along a face passing through the temperature detection element, a gradient moderating portion having a step smaller than a step from a surface of the substrate to a surface of the overlapping portion is arranged at a position adjacent to the overlapping portion.

Next, a fourth exemplary embodiment will be described. The present exemplary embodiment is characterized in that a gradient moderating portion is necessarily provided only in the direction D1. Different from the third exemplary embodiment, the gradient moderating portion does not exist in all or a part of the area in the direction D2.

Basic configurations and operations of the image forming apparatus 100 and the fixing device 7 are similar to those described in the third exemplary embodiment. Only a shape on the sliding face side of the heater 12 mounted on the fixing device 7 is different.

<Features of Heater>

Figure 20A:
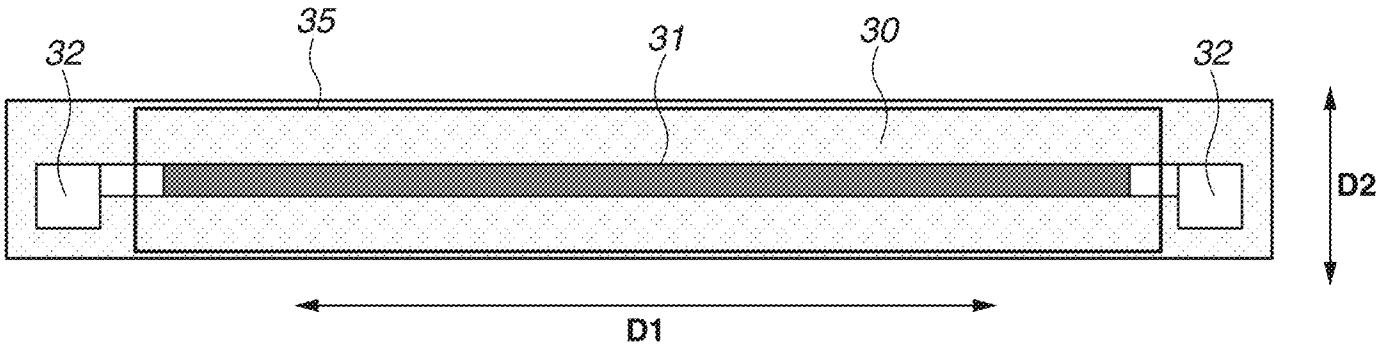
FIGS. 20A and 20B are diagrams illustrating a heater according to a forth exemplary embodiment.
Figure 20B:
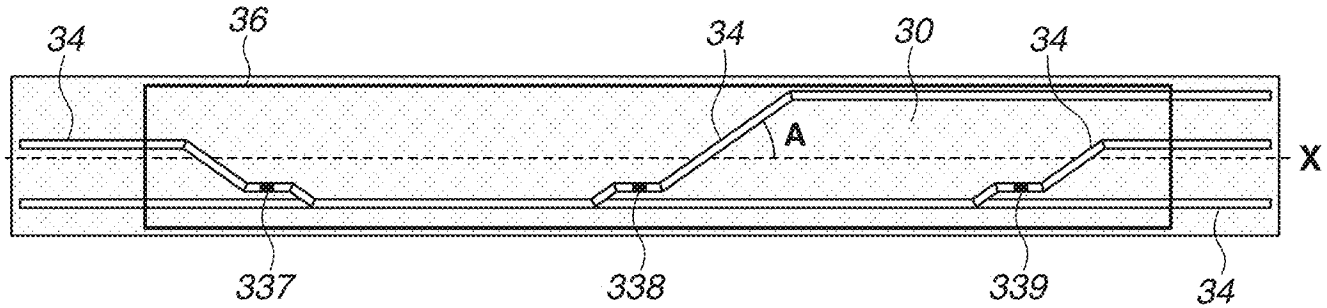

The features of a heater used in the fourth exemplary embodiment will be described. FIG. 20A is a diagram illustrating a back face side of the substrate 30 having the shape similar to the shape of the third exemplary embodiment in FIG. 14A. FIG. 20B is a diagram illustrating a sliding face side thereof, and the configuration is similar to that of the third exemplary embodiment in FIG. 14B except for the portion described below. A configuration different from the third exemplary embodiment will be described with reference to FIGS. 21A, 21B, and 21C.

Figure 21A:
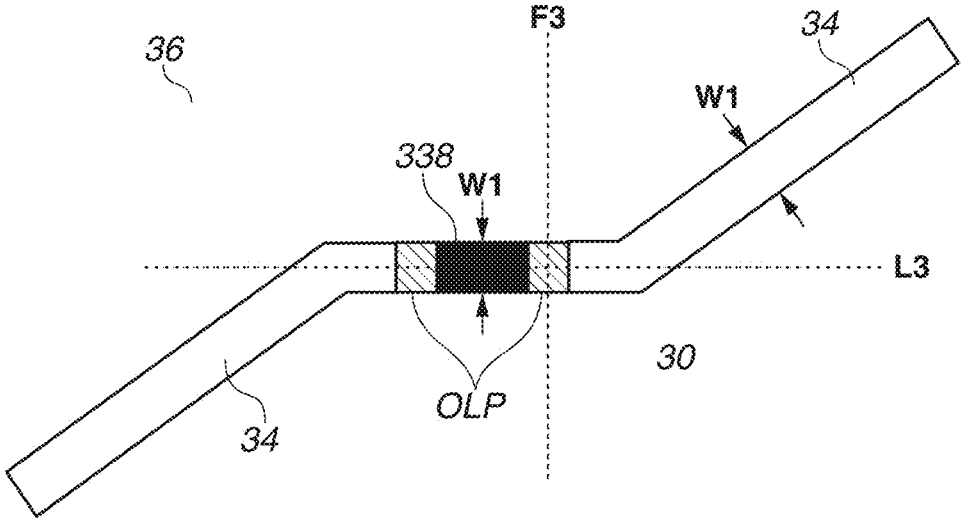
FIGS. 21A, 21B, and 21C are diagrams illustrating a connection portion of a thermistor and a conductive line according to the forth exemplary embodiment.
Figure 21B:
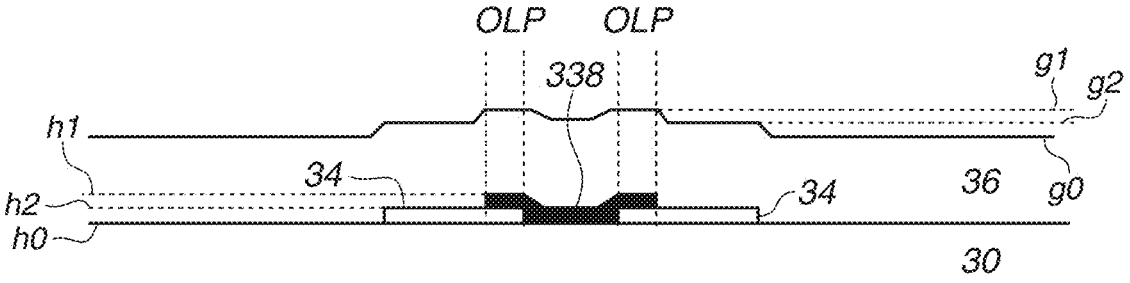
Figure 21C:
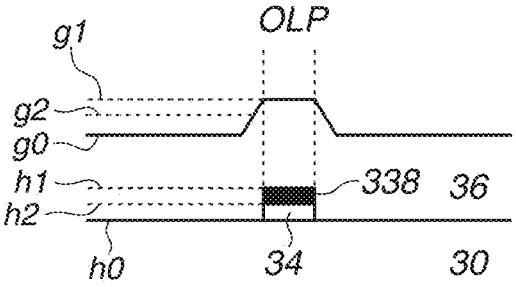

FIG. 21A is a proximal enlarged diagram of a thermistor 338, and the widths of both of the thermistor 338 and the conductive line 34 are the width W1. In the present exemplary embodiment, the width W1 is also set to 0.5 mm, and different from the third exemplary embodiment, the conductive line 34 at a portion connected with the thermistor 338 also has the width W1. Configurations other than the above-described configuration are similar to those described in the third exemplary embodiment. FIG. 21B is a cross section diagram taken along a line L3 in FIG. 21A, which is completely the same as the cross section diagram in FIG. 15B described in the third exemplary embodiment. FIG. 21C is a cross section diagram taken along a line F3 in FIG. 21A.

As described above, in the present exemplary embodiment, the widths of both of the thermistor 338 and the conductive line 34 are the same width W1, so that the thermistor 338 and the conductive line 34 precisely overlap with each other. Therefore, different from the cross-sectional face at the line F1 in the third exemplary embodiment in FIG. 15C, a gradient moderating portion does not exist in the cross-sectional face at the line F3. Accordingly, in the present exemplary embodiment, variation in height of a surface of the second protection layer 36 in the cross-sectional face at the line F3 becomes steeper than that of the third exemplary embodiment.

When verification was conducted under the condition the same as the condition for verifying the effect of the third exemplary embodiment, a fixing failure as well as a gloss streak did not occur in the present exemplary embodiment. This result indicates that an image defect can be prevented if a gradient moderating portion exists in the direction D1. This is because of the following reasons.

In the present exemplary embodiment, although a steep step exists in the direction D2, it is only for a short period that the contact pressure with respect to an inner periphery of the film is lowered, the pressure becomes lower than the pressure in other portions, and the heat-transfer efficiency becomes lower. Therefore, an influence with respect to the image is small, and thus an image defect such as a fixing failure or a gloss streak does not occur.

As described above, it is preferable that the conductive line 34 be arranged so that the gradient moderating portion appears at least in the cross-sectional structure at the line L3.

Figure 22A:
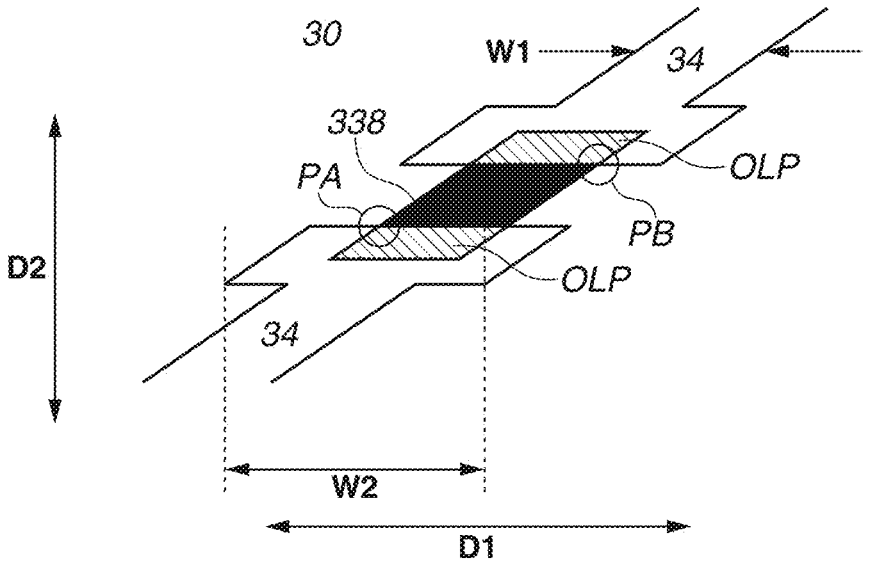
FIGS. 22A and 22B are diagrams illustrating a connection portion of a thermistor and a conductive line according to variation examples of the fourth exemplary embodiment.
Figure 22B:
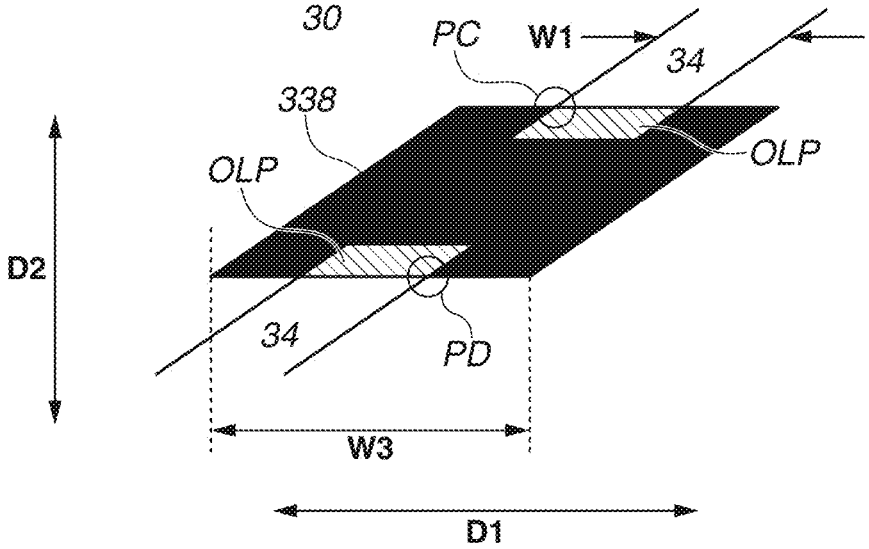

Next, configurations of variation examples of the present exemplary embodiment will be described. In these configurations, the gradient moderating portion necessarily exists in the direction D1 although the gradient moderating portion does not exist in a part of the area in the direction D2. With reference to FIGS. 22A and 22B, two variation examples, i.e., variation examples 3 and 4, will be described as the variation examples of the present exemplary embodiment.

Variation Example 3

In the configuration of the variation example 3 illustrated in FIG. 22A, the thermistor 338 is arranged in the inclined state, and two portions thereof connected to the conductive line 34 are also arranged in the inclined state. However, as illustrated in FIG. 22A, the thermistor 338 does have a parallelogram shape, not a rectangle shape. Further, the conductive line 34 in a vicinity of the connection portion and the overlapping portion OLP also have parallelogram shapes. With this configuration, a part of the conductive line 34 necessarily exists as the gradient moderating portion in the direction D1.

On the other hand, in the direction D2, although the conductive line 34 or the thermistor 338 exists as the gradient moderating portion in most of the portions, the gradient moderating portion does not exist in points PA and PB in FIG. 22A. However, because the gradient moderating portion does not exist only in the two points PA and PB, the influence exerted on the image is smaller than the influence in the second exemplary embodiment, so that an image defect did not occur in the verification conducted under the same condition.

Variation Example 4

In the configuration of the variation example 4 illustrated in FIG. 22B, a relationship between the widths of the thermistor 338 and the conductive line 34 at the connection portion described in the third exemplary embodiment is reversed. Therefore, a part of the thermistor 338 always exists as the gradient moderating portion in the direction D1.

On the other hand, in the direction D2, although the conductive line 34 or the thermistor 338 exists as the gradient moderating portion in most of the area, the gradient moderating portion does not exist in points PC and PD in FIG. 22B. However, because the gradient moderating portion does not exist only in the above-described two points PC and PD, the influence exerted on the image is smaller than the influence in the second exemplary embodiment, so that an image defect did not occur in the verification conducted under the same condition.

In addition, configurations described in the third and the fourth exemplary embodiments are also applicable to the heater capable of independently controlling the plurality of heat generating resistors illustrated in FIG. 12.

While the present invention has been described with reference to exemplary embodiments, it is to be understood that the invention is not limited to the disclosed exemplary embodiments.

What is claimed is:

1. A heater used for a fixing device comprising:

a substrate having a lengthwise direction and a widthwise direction;

a heat generation element arranged on the substrate;

a temperature detection element arranged on the substrate;

two conductive lines for extracting signal corresponding to temperature electrically connected to the temperature detection element, the two conductive lines being arranged on the same face of the substrate on which the temperature detection element is arranged; and a protection layer that covers the temperature detection element and the two conductive lines, wherein a first conductive line, which is one of the two conductive lines is arranged to extend from the temperature detection element toward one end portion of the substrate in the lengthwise direction of the substrate, and a second conductive line, which is the other conductive line of the two conductive lines is arranged to extend from the temperature detection element toward the other end portion of the substrate in the lengthwise direction of the substrate, wherein the first conductive line is arranged in an area extending from a first position where the temperature detection element is arranged in the width direction of the substrate to a second position different from the first position in the width direction of the substrate, and wherein the first conductive line has a region inclined with respect to both the lengthwise and widthwise directions of the substrate and-de does not have a region extending only in a direction parallel to the widthwise direction of the substrate in an area covered by the protection layer.

2. The heater according to claim 1, wherein if the temperature detecting element is called a first temperature detecting element, and the two conductive lines is called two first conductive lines, the heater further comprising a second temperature detection element and two second conductive lines arranged on the same face of the substrate on which the first temperature detecting element is arranged, wherein one of the second conductive lines is arranged to extend from the temperature detection element toward one end portion of the substrate in the lengthwise direction of the substrate, and the other of the second conductive line is arranged to extend from the temperature detection element toward the other end portion of the substrate in the lengthwise direction of the substrate, and wherein the one of the first conductive line and the one of the second conductive line are the same conductive line.

3. The heater according to claim 1, wherein the heater includes a plurality of independently-controllable heat generation elements arranged in the lengthwise direction of the substrate.

4. A fixing device for fixing an image formed on a recording material onto the recording material, the fixing device comprising:

a tubular film; and a heater, as claimed in claim 1, being arranged in contact with an inner face of the film, wherein the heater is arranged in contact with the inner face of the film on a side of the face on which the temperature detection element is arranged.

5. The fixing device according to claim 4, further comprising a pressure roller configured, with the heater via the film, to form a fixing nip portion for nipping and conveying the recording material.

6. A heater used for a fixing device comprising:

a substrate having a lengthwise direction and a widthwise direction;

a heat generation element arranged on the substrate;

a plurality of temperature detection elements arranged on the substrate;

a plurality of conductive line groups, each of the plurality of conductive line groups includes two conductive lines for extracting signal corresponding to temperature electrically connected to each of the plurality of temperature detection elements, the plurality of conductive line groups being arranged on the same face of the substrate on which the plurality of temperature detection elements are arranged; and a protection layer that covers the plurality of temperature detection elements and the plurality of conductive line groups, wherein a first conductive line, which is one of the two conductive lines in each of the plurality of the conductive line groups is arranged to extend from one of the plurality of temperature detection elements toward one end portion of the substrate in the lengthwise direction of the substrate, and a second conductive line, which is the other conductive line of the two conductive lines in each of the plurality of the conductive line groups is arranged to extend from the one of temperature detection element toward the other end portion of the substrate in the lengthwise direction of the substrate, wherein a first conductive line in each of the plurality of the conductive line groups is arranged in an area extending from a first position where the temperature detection element is arranged in the width direction of the substrate to a second position different from the first position in the width direction of the substrate, and wherein the first conductive line in each of the plurality of the conductive line groups has a region inclined with respect to both the lengthwise and widthwise directions of the substrate and does not have a region extending only in a direction parallel to the widthwise direction of the substrate in an area covered by the protection layer.

7. The heater according to claim 6, wherein the heater includes a plurality of independently-controllable heat generation elements arranged in the lengthwise direction of the substrate.

8. A fixing device for fixing an image formed on a recording material onto the recording material, the fixing device comprising:

a tubular film; and a heater, as claimed in claim 6, being arranged in contact with an inner face of the film, wherein the heater is arranged in contact with the inner face of the film on a side of the face on which the temperature detection element is arranged.

9. The fixing device according to claim 8, further comprising a pressure roller configured, with the heater via the film, to form a fixing nip portion for nipping and conveying the recording material.

10. A heater used for a fixing device comprising:

a substrate having a lengthwise direction and a widthwise direction;

a heat generation element arranged on the substrate;

a temperature detection element arranged on the substrate;

two conductive lines for extracting signal corresponding to temperature electrically connected to the temperature detection element, the two conductive lines being arranged on the same face of the substrate on which the temperature detection element is arranged; and a protection layer that covers the temperature detection element and the two conductive lines, wherein a first conductive line, which is one of the two conductive lines is arranged to extend from the temperature detection element toward one end portion of the substrate in the lengthwise direction of the substrate, and a second conductive line, which is the other conductive line of the two conductive lines is arranged to extend from the temperature detection element toward the other end portion of the substrate in the lengthwise direction of the substrate and then turns and extends to the one end portion of the substrate, wherein the second conductive line is arranged in an area extending from a first position where the temperature detection element is arranged in the width direction of the substrate to a second position different from the first position in the width direction of the substrate, and wherein the second conductive line has a region inclined with respect to both the lengthwise and widthwise directions of the substrate and-de does not have a region extending only in a direction parallel to the widthwise direction of the substrate in an area covered by the protection layer.

11. The heater according to claim 10, wherein if the temperature detection element is called a first temperature detection element, the heater further comprising a second temperature detection element arranged on the same face of the substrate on which the first temperature detection element is arranged, wherein the second conductive line of the first temperature detection element and the second conductive line of the second temperature detection element are the same conductive line.

12. The heater according to claim 10, wherein the heater includes a plurality of independently-controllable heat generation elements arranged in the lengthwise direction of the substrate.

13. A fixing device for fixing an image formed on a recording material onto the recording material, the fixing device comprising:

a tubular film; and a heater, as claimed in claim 10, being arranged in contact with an inner face of the film, wherein the heater is arranged in contact with the inner face of the film on a side of the face on which the temperature detection element is arranged.

14. The fixing device according to claim 13, further comprising a pressure roller configured, with the heater via the film, to form a fixing nip portion for nipping and conveying the recording material.

15. A heater used for a fixing device comprising:

a substrate having a lengthwise direction and a widthwise direction;

a heat generation element arranged on the substrate;

a plurality of temperature detection elements arranged on the substrate;

a plurality of conductive line groups, each of the plurality of conductive line groups includes two conductive lines for extracting signal corresponding to temperature electrically connected to each of the plurality of temperature detection elements, the plurality of conductive line groups being arranged on the same face of the substrate on which the plurality of temperature detection elements are arranged; and a protection layer that covers the plurality of temperature detection elements and the plurality of conductive line groups, wherein a first conductive line, which is one of the two conductive lines in each of the plurality of the conductive line groups is arranged to extend from one of the plurality of temperature detection elements toward one end portion of the substrate in the lengthwise direction of the substrate, and a second conductive line, which is the other conductive line of the two conductive lines in each of the plurality of the conductive line groups is arranged to extend from the one of temperature detection element toward the other end portion of the substrate in the lengthwise direction of the substrate and then turns and extends to the one end portion of the substrate, wherein the second conductive line in each of the plurality of the conductive line groups is arranged in an area extending from a first position where the temperature detection element is arranged in the width direction of the substrate to a second position different from the first position in the width direction of the substrate, and wherein the second conductive line in each of the plurality of the conductive line groups has a region inclined with respect to both the lengthwise and widthwise directions of the substrate and does not have a region extending only in a direction parallel to the widthwise direction of the substrate in an area covered by the protection layer.

16. The heater according to claim 15, wherein the heater includes a plurality of independently-controllable heat generation elements arranged in the lengthwise direction of the substrate.

17. A fixing device for fixing an image formed on a recording material onto the recording material, the fixing device comprising:

a tubular film; and a heater, as claimed in claim 15, being arranged in contact with an inner face of the film, wherein the heater is arranged in contact with the inner face of the film on a side of the face on which the temperature detection element is arranged.

18. The fixing device according to claim 17, further comprising a pressure roller configured, with the heater via the film, to form a fixing nip portion for nipping and conveying the recording material.

* * * * *